US006519441B1

(12) United States Patent
Sawada

(10) Patent No.: US 6,519,441 B1
(45) Date of Patent: Feb. 11, 2003

(54) ROLL PAPER UNIT HAVING PAPER PATH SWITCHING MEMBER AND IMAGE FORMING APPARATUS EMPLOYING THE SAME

(75) Inventor: Yasushi Sawada, Mitaka (JP)

(73) Assignee: Copyer Co., Ltd., Tokyo (JP)

( * ) Notice: Subject to any disclaimer, the term of this patent is extended or adjusted under 35 U.S.C. 154(b) by 0 days.

(21) Appl. No.: 09/341,455

(22) PCT Filed: Jan. 13, 1998

(86) PCT No.: PCT/JP98/00082

§ 371 (c)(1),
(2), (4) Date: Sep. 9, 1999

(87) PCT Pub. No.: WO98/30482

PCT Pub. Date: Jul. 16, 1998

(30) Foreign Application Priority Data

Jan. 13, 1997 (JP) ..... 09-004166
Jan. 13, 1997 (JP) ..... 09-004167
Jan. 13, 1997 (JP) ..... 09-004168
Jan. 13, 1997 (JP) ..... 09-004169

(51) Int. Cl.[7] ..... G03G 15/00
(52) U.S. Cl. ..... 399/384; 399/385; 399/387
(58) Field of Search ..... 399/9, 384, 385, 399/386, 387, 367, 375, 388, 389, 390; 271/9.1, 256, 258.01; 83/110, 208, 209

(56) References Cited

U.S. PATENT DOCUMENTS 5,072,306 A * 12/1991 Matsumoto et al. ..... 399/385
5,216,417 A * 6/1993 Kajita et al. ..... 399/385
5,708,345 A * 1/1998 Kramer et al. ..... 399/385
5,758,248 A * 5/1998 Yoshiuchi et al. ..... 399/385
6,229,983 B1 * 5/2001 Sawada ..... 399/385

FOREIGN PATENT DOCUMENTS

| | | |
|---|---|---|
| JP | 48-56145 | 8/1973 |
| JP | 51-156843 | 12/1976 |
| JP | 62-83164 | 4/1987 |
| JP | 2-119473 | 9/1990 |

* cited by examiner

*Primary Examiner*—Hoang Ngo
(74) *Attorney, Agent, or Firm*—Dellett & Walters

(57) ABSTRACT

When a roll paper unit 200 is incorporated into an image formation apparatus, a second outlet guide member 92 is turned around a pivot 92*a* in the direction of an arrow G, i.e., moved from a position of solid lines to a position of two-dot chain lines, a rear end portion 92*b* of this second outlet guide member 92 pressing down a front end portion 80*c* of a guide member 80 to cause the guide member 80 to be turned around a central shaft 80*d* in the direction of an arrow H, i.e., moved from a position of solid lines to a position of two-dot chain line. Consequently, a path extending in the direction of an arrow C is closed, while a path extending in the direction of an arrow F is opened, the roll paper 72 being transferred in the paper feed direction. When the roll paper unit 200 is drawn out, the second outlet guide member 92 and the guide member 80 are turned in the directions opposite to those mentioned above. Consequently, the path extending in the direction of the arrow F is closed, while the path extending in the direction of the arrow C is opened, the roll paper 72 being transferred in the paper discharge direction.

28 Claims, 19 Drawing Sheets

ROLL PAPER UNIT HAVING PAPER PATH SWITCHING MEMBER AND IMAGE FORMING APPARATUS EMPLOYING THE SAME

TECHNICAL FIELD

The present invention relates to a roll paper unit for holding a roll of paper, and an image formation apparatus equipped with the roll paper unit.

BACKGROUND TECHNIQUE

Ink-jet type image formation apparatuses for forming images by ink ejection on a printing medium, and electrophotography type image formation apparatuses for forming images by use of a developer on a printing medium are known as the output device of computers and workstations. Some of the image formation apparatuses are of the type which uses selectively cut paper sheets or roll paper as the printing medium. Some of them are of the type which uses roll paper only. An image formation apparatus which uses roll paper is usually equipped with a roll paper unit. The roll paper is cut in a prescribed size by a cutter provided in the roll paper unit, and the cut paper sheets are delivered to the image formation section in the apparatus to form images. This roll paper unit has several problems (inconveniences).

A first problem is explained below.

In formation of an image on the roll paper, the front end portion of the roll paper can be placed obliquely or be cut irregularly. To prevent the delivery failure or the defective image formation by the irregularity, after exchange of the paper roll or treatment of paper jamming, the front end portion of the roll paper is usually cut off and removed, and the front end of the roll paper is registered to be at the prescribed position. This operation is called precutting. After this precutting, the cut sheet of the roll paper is delivered to the image formation section to form an image on the paper sheet. Therefore, the roll paper unit has a paper discharge path for discharging the unnecessary precut paper piece, and a paper feed path for feeding the roll paper to the image formation section. The paper path is switched selectively for paper discharge or for paper feed, as necessary. The switching mechanism has complicated construction owing to the necessary parts such as a solenoid.

The image formation apparatus having the roll paper unit mounted in a demountable manner requires the operations of mounting the roll paper unit, precutting of the front end portion of the roll paper, and switching of the paper path for paper discharge or for paper feed, which are not simple. Additionally, a mechanism is necessary for removing the precut unnecessary paper piece from the paper discharge path. Thus, the structure is complicated. This is the first problem.

Next, a second problem is explained below.

FIG. 19 shows a bar-shaped spool with a roll-paper set thereon.

Generally, roll paper 72 is paper wound in a shape of a cylinder having hollow core portion 72*a* as shown in FIG. 19, and is set, together with bar-shaped spool 74 inserted into core portion 72*a*, in the roll paper unit. Therefore, the roll paper 72 is placed coaxially with bar-shaped spool 74 in the roll paper unit. Incidentally, into the each end portion of spool 74, stopper 75 is fitted respectively to set roll paper 72 and spool 74 coaxially and to prevent the movement of roll paper 72 along the length direction of spool 74.

The roll paper unit has a spool holder for holding rotatably both ends of spool 74, so that spool 74 inserted into core portion 72*a* of paper roll 72 is held rotatably by the spool holder to feed the rolled paper. When the paper roll has been used up or the roll paper is exchanged to a different size of roll paper, the spool is taken out of the spool holder and is inserted into a core portion of another new paper roll, and then the spool is again set in the spool holder.

In such a roll paper unit, the spool is placed in a direction perpendicular to the feed direction of the roll paper to prevent oblique movement of the roll paper. For this purpose, the spool holder is fixed in the roll paper unit perpendicularly to the paper feed direction. This spool holder should be set removably in the roll paper unit. If the spool holder is fixed firmly to the roll paper unit, the spool cannot simply be taken out of the roll paper unit or set therein. This is the second problem.

A third problem is explained below.

In formation of an image by use of paper roll, the roll paper is cut into a prescribed size of sheets before feeding to the image formation section to form an image. For this purpose, the roll paper unit has a cutter for cutting the roll paper into the desired size. At the upstream side of the cutter in the paper feed direction, a guide plate is provided for guiding the roll paper to the cutter. Above the guide plate, a movable pressing plate made of a metal is provided for pressing the rolled paper sheet against the guide member during movement of the cutter along the roll paper sheet for cutting it. By the pressing the roll paper with the pressing plate against the guide plate, the rolled paper can be cut precisely by the cutter.

Near the cutter in the roll paper unit, a sensor is provided for detecting the roll paper. After cutting the roll paper with the cutter, the front end of the roll paper is moved forward and backward in the vicinity of the sensor. In this movement, the pressing plate is detached from the guide plate to facilitate the movement of the roll paper front. The pressing plate which is set movably for this purpose, is controlled to press the roll paper sheet against the guide plate on cutting of the roll paper, and to be apart from the guide plate during the back-and-forth movement of the roll paper front around the sensor. This requires the parts and controllers for moving the pressing plate, which makes the structure complicated. This is the third problem.

A fourth problem is explained below.

The roll paper or cut paper sheet is gripped and delivered usually by plural pairs of delivery rollers through a delivery path formed from a metal plate or the like. During the delivery of the roll paper or cut sheet, paper jamming can sometimes occur. The jamming roll paper sheet or cut paper sheet should be removed. However, the treatment of the jamming paper sheet stopping in the delivery path is conducted by opening the delivery path, releasing the delivery rollers, and removing the jamming paper by hand from a narrow space, which is a troublesome operation. This is the fourth problem.

As described above, the conventional roll paper unit has several problems.

DISCLOSURE OF INVENTION

In view of the above situations, the present invention intends to provide a paper roll unit and an image formation apparatus having a relatively simple structure and is readily handleable.

A first embodiment of the roll paper unit of the present invention for solving the aforementioned first problem constitutes an image formation apparatus which has an image formation section for forming an image on roll paper, conducts precutting of a front end portion of the roll paper, and feeds the roll paper having been cut at the front end portion in a prescribed feed direction to the image formation section, the roll paper unit (1) being incorporated demountably into the image formation apparatus, and (2) having a switching member for switching a paper delivery path to a direction for discharging the roll paper when the unit is demounted, and switching the paper delivery path to another direction for feeding the roll paper when the unit is incorporated into the image formation apparatus.

The roll paper unit may have (3) a constitution such that the front end portion of the roll paper to be precut is drawn out of the image formation apparatus when the roll paper unit is incorporated into the image formation apparatus.

Further, the roll paper unit may have (4) a cutter for precutting the roll paper at the prescribed paper discharge path when the roll paper unit is incorporated into the image formation apparatus.

The switching member may have (5) a plate-shaped guide member which switches over a roll paper guiding face to a front side or to a reverse side corresponding to the demounted state or the incorporated state of the roll paper unit.

The plate-shaped guide member may have (6) a protrusion for guiding the roll paper on at least one of the front face and the reverse face.

A first embodiment of the image formation apparatus of the present invention is characterized by (7) the roll paper unit described in the above items (1) to (6), (8) the roll paper unit having a roll paper cover for covering the roll paper unit, and (9) a slit formed between an outside cover and the roll paper cover for discharging the precut front end portion of the roll paper.

A second embodiment of the roll paper unit of the present invention for solving the aforementioned second problem has an aperture for placing the roll paper set on a bar-shaped spool in an image formation apparatus for forming an image on roll paper, the roll paper unit being characterized in that it has

(10) a roll paper cover for closing and opening the aperture, and

(11) a pair of spool holders which are independently turned by opening and closing of the roll paper cover between the spool-removal position and the roll paper feed position with the both ends of the spool held rotatably,

(12) the pair of the spool holders are kept at the removal position when the roll paper cover is opened, and are turned from the removal position to the paper feed position by pushing with the roll paper cover when the roll paper cover is closed, and

(13) the central shaft of the above turning movement is fixed to the roll paper unit, where

(14) the roll paper unit may have a fixing member which is fixed movably in a direction approximately perpendicular to the direction of the spool shaft, and fixes the closed roll paper cover to the roll paper unit.

The second embodiment of the image formation apparatus of the present invention for solving the aforementioned third problem, having a cutter for cutting the roll paper, and forming an image on the roll paper cut by the cutter, is characterized in that it has

(15) a guide plate placed near the cutter for guiding the roll paper to the cutter, and

(16) a flexible plate-shaped member for pressing the roll paper against the guide plate for guiding the roll paper, where

(17) the plate-shaped member may be formed from a resin film.

A third embodiment of the image formation apparatus for solving the aforementioned fourth problem, which forms an image selectively on roll paper or a cut paper sheet, is characterized in that it has

(18) a roll paper unit for holding a roll paper, incorporated demountably into the main body of the image formation apparatus, and

(19) the roll paper unit has a cutter of cutting the roll paper.

A forth embodiment of the image formation apparatus for solving the aforementioned fourth problem, which forms an image selectively on roll paper or on a cut paper sheet, is characterized in that it has

(20) a roll paper unit for holding a roll paper, incorporated demountably into the main body of the image formation apparatus,

(21) a cassette for storing the cut paper sheets, and

(22) a paper delivery path for delivering the cut paper sheets stored in the cassette, and being opened when the roll paper unit is demounted from the main body of the image formation apparatus.

The above image formation apparatus of the third or fourth embodiment may have

(23) registration rollers for holding the roll paper therebetween and delivering the roll paper at a predetermined timing to the image formation Section, and

(24) a reversal-preventing member for preventing reverse rotation of the registration roller; and

(25) the roll paper unit may have such a structure that the roll paper is unwound, when the roll paper unit is demounted from the main body of the roll paper unit with the roll paper is held by the registration roller.

BEST MODE FOR PRACTICING THE INVENTION

The modes of practicing the present invention is described by reference to drawings.

Figure 1:
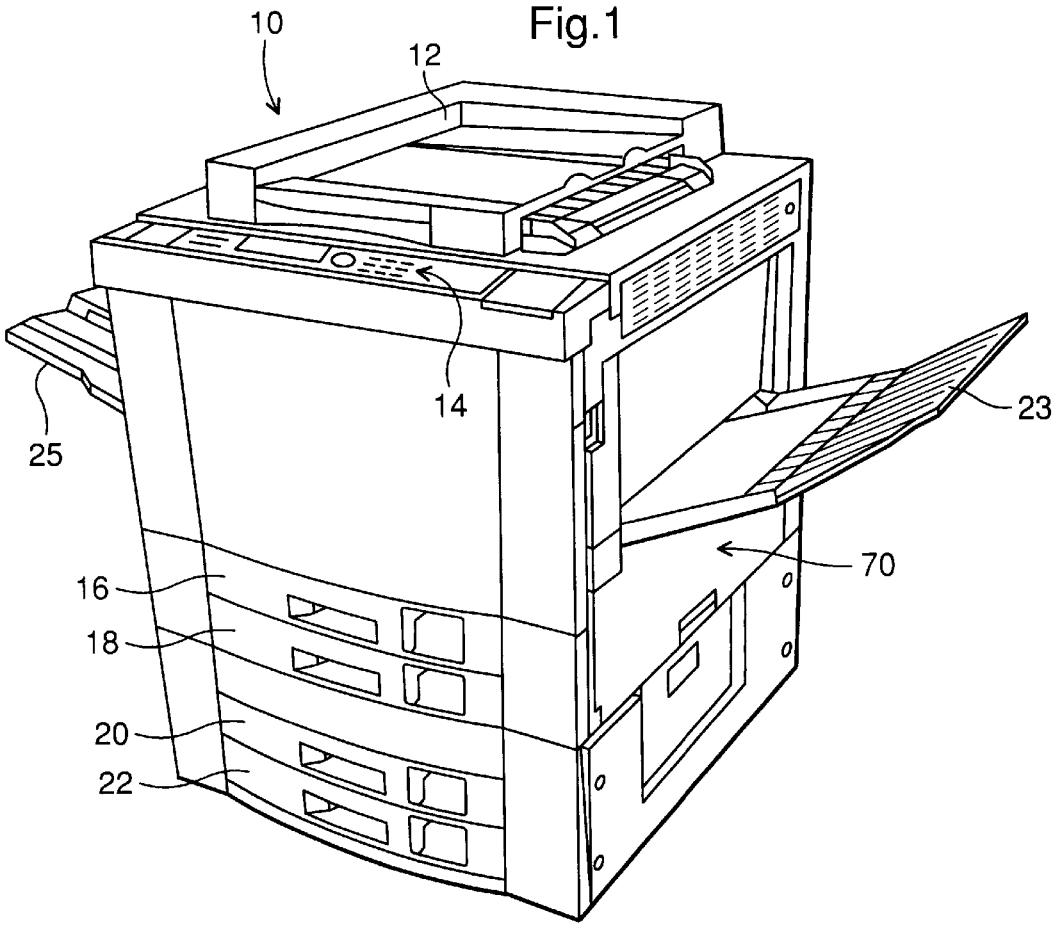
FIG. 1 is a perspective view of an outside appearance of a copying machine equipped with a roll paper unit of one embodiment of the present invention.

FIG. 1 is a perspective external view of a copying machine having an embodiment of a roll paper unit incorporated therein.

On the top face of copying machine 10 (an example of the image formation apparatus in the present invention), there is placed an openable document table cover 12. The document table cover 12 also serves as a document feeder (DF) for feeding a source document to the document table. At the front side of the top face, operation panel 14 is placed for inputting the number of reproduced copies, and so forth. This copying machine 10 is capable of forming an image selectively either on a cut paper sheet or on roll paper. This copying machine has four cassettes 16,18,20,22 which store respectively cut paper sheets and are demountable from the main body of copying machine 10. Additionally, the copying machine has roll paper unit 70 which is demountable from copying machine 70. Further, copying machine 10 has manual feed tray 23 for feeding a smaller size of recording paper such as a post card. The copying machine has discharged-paper tray 25 also for holding recording paper sheets after image formation.

The process for formation of an image with copying machine 10 of FIG. 1 is explained below by reference to FIG. 2.

Figure 2:
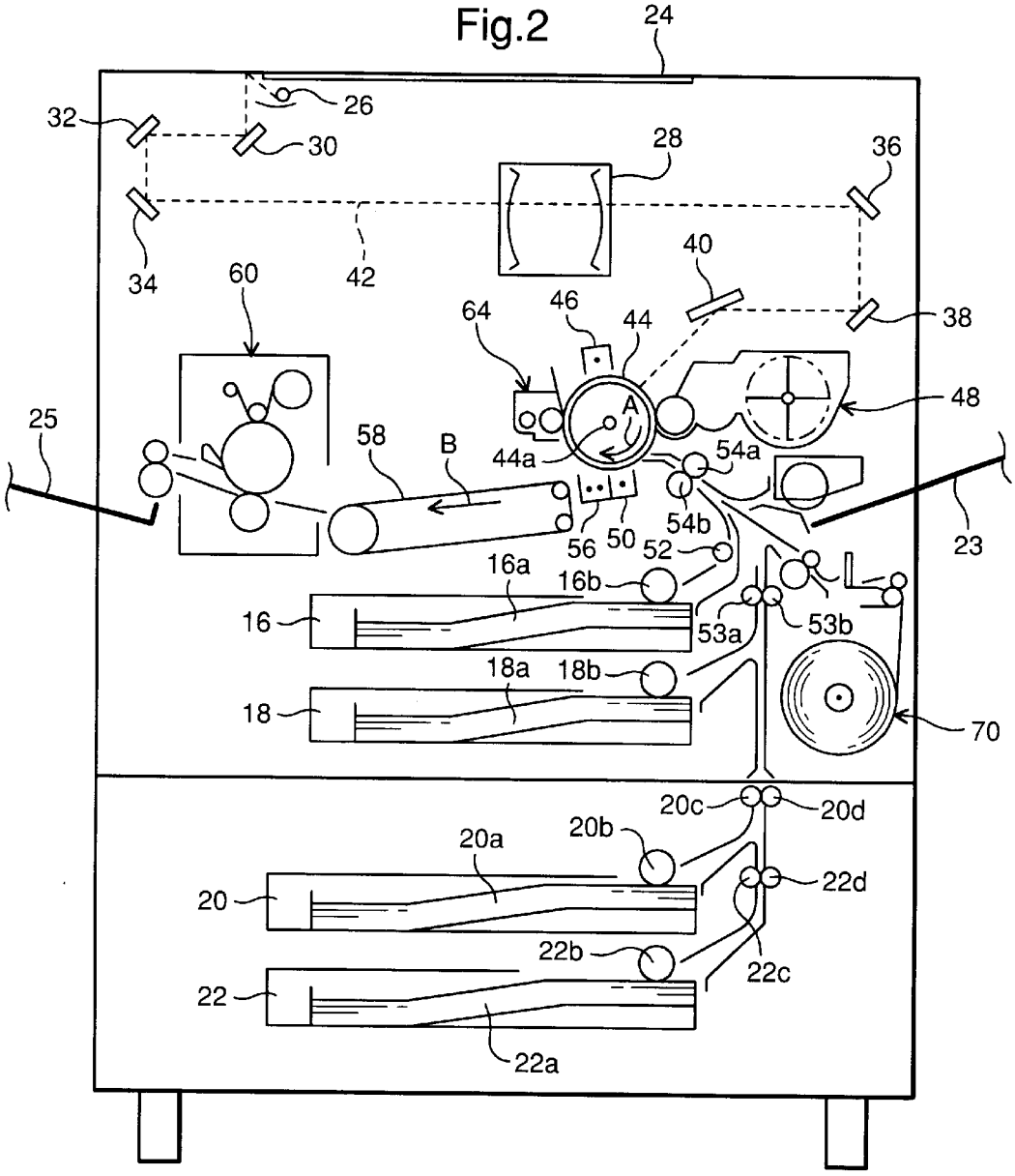
FIG. 2 is a schematic drawing of showing roughly the internal structure of the copying machine shown in Fig.

FIG. 2 is a schematic drawing showing roughly the internal structure of copying machine 10.

Document-supporting glass plate 24 is placed under document table cover 12 (see FIG. 1). A light-exposure optical system is provided below document-supporting glass plate 24 to illuminate the source document to obtain signal carrying image information. This light-exposure optical system includes light source 26, lens 28, mirrors 30,32,34,36,38,40. A source document placed on document-supporting glass plate 24 is exposed to light from light source 26, and reflected light 42 from the source document is projected as image signals through lens 28, and mirrors 30,32,34,36,38,40 to photosensitive drum 44 placed below the light-exposure optical system.

Photosensitive drum 44 has a rotation shaft 44*a* in the direction vertical to the drawing paper face, rotating in the direction shown by an arrow A. A primary electrifier 46 is provided on the upstream side, in the rotation direction, of photosensitive drum 44 from the position of projection of light reflected by the source document to electrify uniformly photosensitive drum 44. After photosensitive drum 44 is electrified uniformly by primary electrifier 46 to form an electrification face, an electrostatic latent image is formed by illumination of reflected light 42 from the source document.

Development device 48 is provided on the downstream side of the above illumination position in the rotation direction of photosensitive drum 44 to develop the electrostatic latent image. The region where photosensitive drum 44 and development 48 device are counterposed is the development region for developing the electrostatic latent image. On arrival of the electrostatic latent image at the development region with rotation of photosensitive drum 44, the electrostatic latent image is developed by development device 48 to form a toner image (developed image).

Transfer electrifier 50 is provided on the downstream side of the development region in the rotation direction of photosensitive drum 44 to transfer the toner image onto a recording paper. The region where photosensitive drum 44 and transfer electrifier 50 are counterposed is a transfer region for transferring the toner image onto the recording paper sheet. On arrival of the toner image at the transfer region by rotation of photosensitive drum 44, the toner image is transferred onto the recording paper sheet delivered to the transfer region.

The recording paper is delivered from cassette 16,18,20,22 or roll paper unit 70 to the transfer region. For delivery of the recording paper to the transfer region, for example, a cut paper sheet is sent out from cassette 16 by paper feed roller 16*b*, and the front end of the cut paper sheet 16*a* is kept in contact with registration rollers 54*a*,54*b* to form a loop. The recording paper sheet is delivered to meet the timing of arrival of the toner image at the transfer region.

Cut paper sheet 18*a* stored in cassette 18 is delivered by paper feed roller 18*b*, and a pair of delivery rollers 53*a*,53*b* to registration rollers 54*a*,54*b*.

Cut paper sheet 20*a* stored in cassette 20 is delivered by paper feed roller 20*b*, a pair of delivery rollers 20*c*,20*d*, and a pair of delivery rollers 53*a*,53*b* to registration rollers 54*a*,54*b*.

Cut paper sheet 22*a* stored in cassette 22 is delivered by paper feed roller 22*b*, a pair of delivery rollers 22*c*,22*d*, a pair of delivery rollers 20*c*,20*d*, and a pair of delivery rollers 53*a*,53*b* to registration rollers 54*a*,54*b*.

The recording paper sheet having received the transferred toner image is separated by separation electrifier 56 from photosensitive drum 44, and is delivered by delivery belt 58 rotating in the arrow-B direction to fixation device 60. By this fixation device 60, the toner image is fixed on the recording paper sheet. After the toner image fixation, the recording paper sheet is discharged through a paper outlet (not shown in the drawing) onto discharged paper tray 25. The toner remaining on photosensitive drum 44 after the image transfer is removed by cleaning device 64 from photosensitive drum 44. The residual electric charge remaining on photosensitive drum 44 is eliminated by a destaticizing lamp (not shown in the drawing). Thus the photosensitive drum 44 is ready for next image formation.

Roll paper unit 70 is explained by reference to FIGS. 3, 4, and 5.

Figure 3:
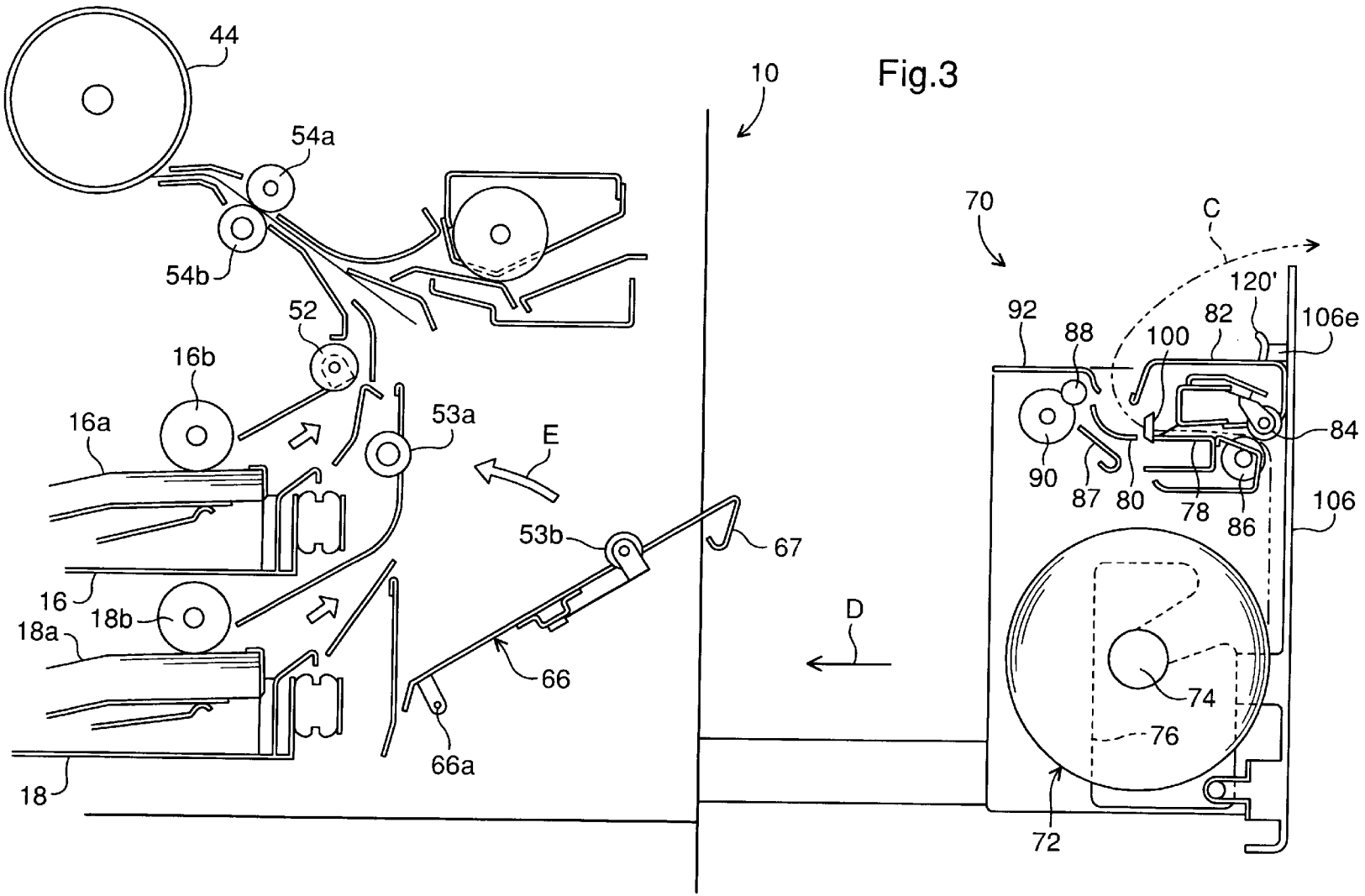
FIG. 3 is a schematic drawing of a roll paper unit demounted from the main body of the copying machine shown in FIG. 1.

FIG. 3 is a schematic drawing of roll paper unit 70 demounted from the main body of copying machine 10. FIG. 4 is a schematic view of roll paper unit 70 incorporated into the main body of copying machine 10. In these drawings, the same symbols are used as in FIG. 2 for the corresponding constitution elements.

Roll paper 72 set on spool 74 is placed in roll unit 70 with the both ends of the spool held rotatably by spool holder 76. As shown in FIG. 3, in a state of roll paper unit 70 demounted from the main body of copying machine 10 (an example of a demounted state), roll paper 72 is guided by cutter lower blade guide 78, face 80*a* (see FIG. 6) of guide plate 80 (an example of the plate-shaped guide member in the present invention), and upper stay 82 to the paper discharge direction (shown by an arrow C) which are provided above roll paper 72. In this state, press roller 84 and paper feed roller (driving roller) 86 for delivering roll paper 72 are kept apart from each other. Also in this state, guide plate 66 in the main body is opened, and delivery rollers 53*a*,53*b* which deliver cut paper 18*a*, or the like from cassette 18, 20, or 22 (cassettes 20 and 22 are not shown in FIG. 3) are apart from each other.

For setting roll paper 72 in roll paper unit 70, firstly roll paper cover 106 is opened, and spool 74 carrying roll paper 72 is fit to spool holder 76. Then paper pressing lever 120 is pulled to move press roller 84 upward for release to give an insertion space for inserting the front end of roll paper 72. The front end of the roll paper 72 is inserted into this insertion space and is delivered through surface 80*a* of guide plate 80 to top of upper stay 82. Then roll paper 72 is registered to prevent oblique movement thereof. Specifically, the front end portion of roll paper 72 is pulled out in a length of about 300 mm, and the right and left edges of roll paper 72 are put on the both ends of the guide plate. After this registration, the paper pressing lever 120 is restored to press the roll paper 72 by press roller 84 against paper feed roller 86 to fix the position of roll paper 72.

The front end portion of the roll paper pulled out for the registration is brought outside, and roll cover 106 is closed. Protrusion 106*e* is provided on roll paper cover 106 to ensure restoration of paper pressing lever and to prevent failure of delivery of roll paper by press roller 84 and paper feed roller 86. Accordingly, if roll cover 106 is closed without restoring paper pressing lever 120, protrusion 106*e* pushes paper pressing lever 120 to restore it.

In such a manner, roll paper unit 70 with roll paper cover 106 closed is incorporated into the main body of copying machine 10. Usually, the thickness of roll paper 72 is. less than 0.5 mm. Therefore, the front portion of roll paper 72 can be discharged through the slit formed in a size of about 1 mm between roll cover 106 and outer cover 10*a*, so that a separate opening need not be provided additionally for discharging the front and portion of roll paper 72.

When precut sensor 101 fixed on stay 10*b* of copying machine 10 detects roll paper 72 brought to the position on upper stay 82 (an example of the paper discharge path in the present invention), a cutter-driving motor (not shown in the drawing) is turned on to drive cutter 100 to cut roll paper by crossing the roll paper. The end of the cut portion of roll paper 72 (precut paper piece), which is outside the main body of copying machine 10, can readily be removed by the operator. Therefore, a precut paper discharge mechanism need not be provided in copying machine 10, thereby the structure being made simpler.

Press roller 84 is explained regarding its operation and construction.

Figure 5:
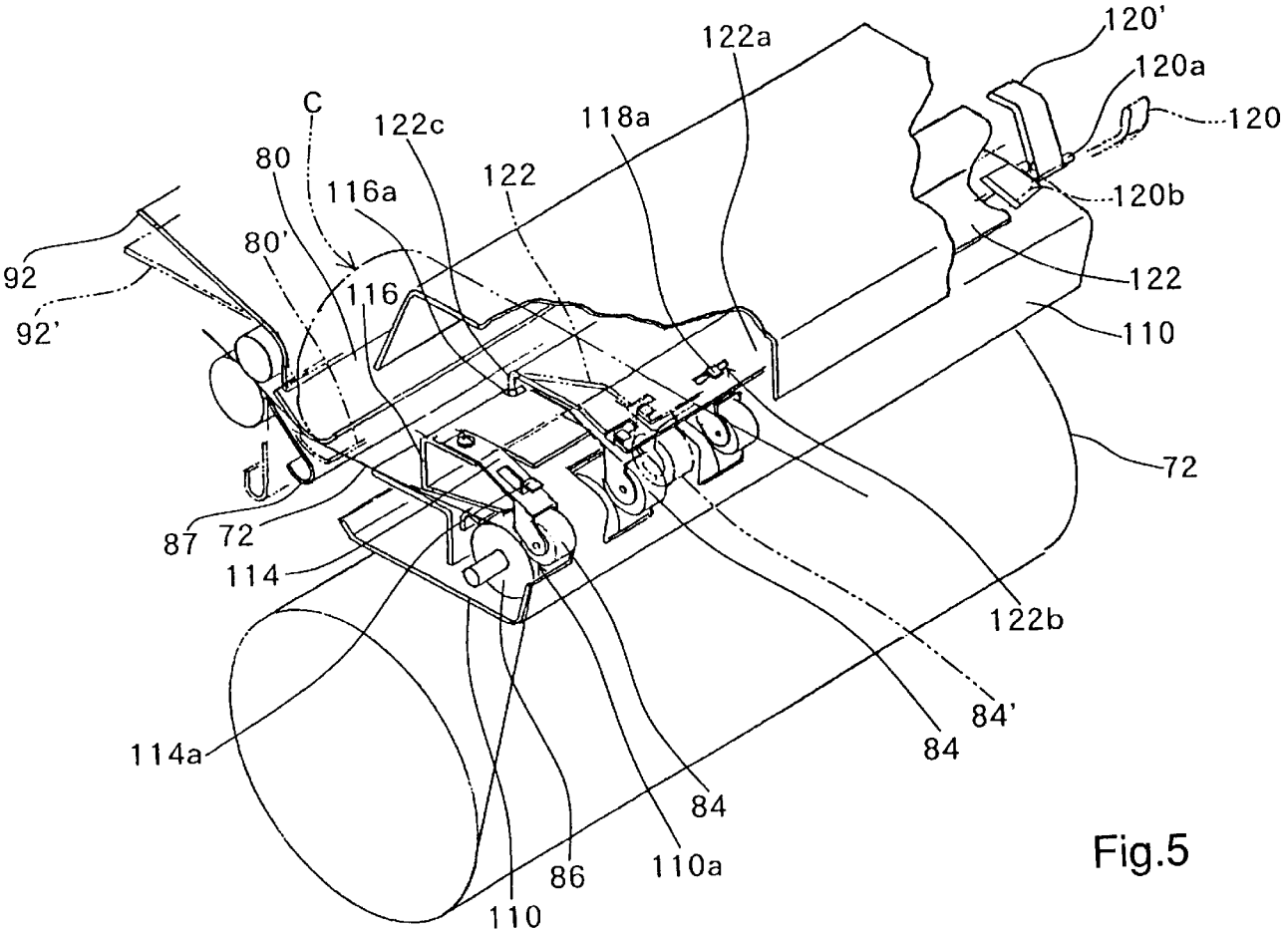
FIG. 5 is a perspective view of a press roller separated from a paper feed roller.

FIG. 5 is a perspective view of press roller 84 separated from paper feed roller 86.

Paper feed roller 86 is fixed rotatably to the main body of roll paper unit 70, and is driven by a motor (not shown in the drawing). Paper feed roller 86 is fixed to expose a part of the roller through opening 110*a* of guide plate 110 for guiding roll paper 72 upward to a lateral direction (toward the image formation section).

On the other hand, press roller 84 is supported rotatably by plate spring 114. This plate spring 114 is fixed at the other end by upper guide plate 116 fixed above lower cutter blade guide 78. Therefore, press roller 84 is normally pressed by plate spring 114 against paper feed roller 86.

Plate spring 114 has hook 114*a* rising upward from the upper face thereof. The tip portion of this hook 114*a* is folded. Onto the upper face of upper guide plate 116, turn plate 122 is fixed such that the tip portion 122*a* thereof turns vertically by operation of paper feed press lever 120. The tip portion 122*a* has an opening 122*b*, through which the tip of hook 114*a* protrudes.

At the rear end portion of turn plate 122, plural nail-shaped protrusions 122*c* are formed. On the upper face of upper guide plate 116, holes 116*a* are formed for insertion of protrusions 122*c*. By insertion of protrusions 122*c* into holes 116*a*, turn plate 122 is made turnable around the rear end portion thereof.

Paper pressing lever 120 is fixed to be turnable around pivot 120*a*. At a portion of paper pressing lever 120 near pivot 120*a*, plate-shaped contact portion 120*b* is provided. This contact portion 120*b* is positioned at the rear bottom side of turn plate 122. When paper pressing lever 120 is at position 120' shown by a solid line, turn plate 122 takes the position shown by the solid line by gravity. When the paper pressing lever is turned around pivot 120*a* to the position indicted by the two-dot chain line 120 to release press roller 84, the contact portion 120*b* is also turned to allow turn plate 122 to turn around protrusions 122*c* at the rear end.

When turn plate 122 is turned to lift tip portion 122*a* of turn plate 122, hook 114*a* of plate spring 114 is caught around opening 122*b* to lift hook 114*a*. With the upward movement of hook 114 lifted, plate spring 114 is also lifted to lift press roller 84 to the position of press roll 84' indicated by the two-dot chain line. Thereby, press roller 84 is disengaged from paper feed roller 86. As mentioned above, press roller 84 and paper feed roller 86 are readily disengaged by turning the paper pressing lever 120 with a simple constitution with high operability at a low cost. In FIG. 5, the two-dot chain line C indicates the path of delivery of roll paper 72 to be precut.

Figure 4:
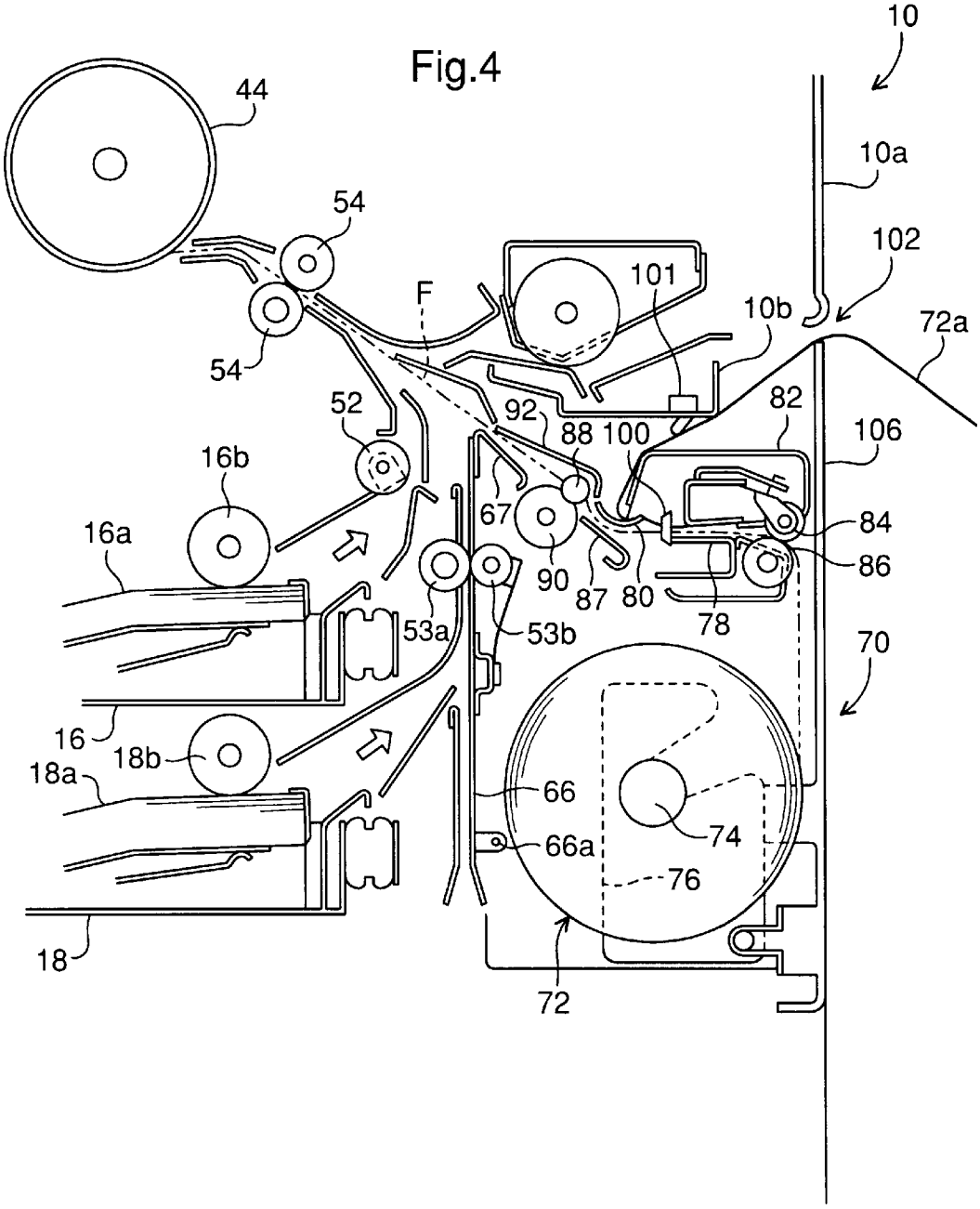
FIG. 4 is a schematic drawing of a roll paper unit incorporated into the main body of the copying machine shown in FIG. 1.

On the other hand, when roll paper unit 70 of FIG. 3 is pushed in the arrow-D direction incorporation into the main body of copying machine 10 as shown in FIG. 4 (an example of the incorporation state in the present invention), guide plate 66 of the main body is turned around pivot 66a in the arrow-E direction for closure. At the top end portion of main body guide plate 66, first outlet guide plate 67 is provided which extends obliquely downward and outward.

As described later by reference to FIG. 6, on incorporation of roll paper unit 70 into the main body of copying machine 10, second outlet guide plate 92 is forced to turn by contact with first outlet guide plate 67, and guide plate 80 also is also turned thereby. Consequently, roll paper 72 is lead through cutter lower blade guide 78 placed above roll paper 72, back face 80*b* of guide plate 80 (see FIG. 6), and swing guide 87 in a paper delivery direction (arrow-F direction) to be held between press roller 88 and curl-taking roller (driving roller) 90. Press roller 88 is made of a metal, and curl-taking roller 90 has a peripheral face made of a sponge. In this state of incorporation, press roller 84 and paper feed roller 86 (driving roller) for delivering roll paper 72 are in contact with each other, and by driving paper feed roller 86 and curl-taking roller 90, roll paper 72 is delivered in the paper feed direction.

The movement and function of guide plate 80 is explained by reference to FIG. 6.

Figure 6:
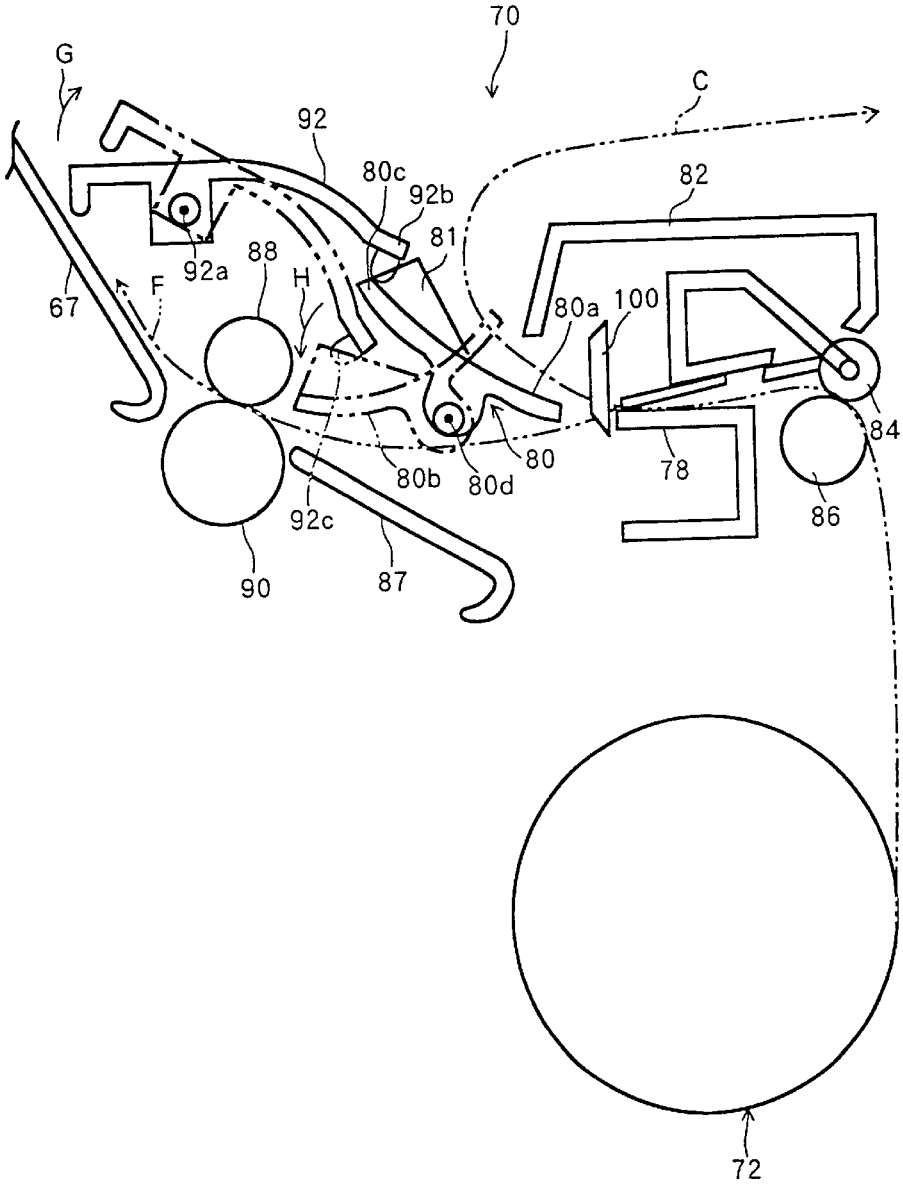
FIG. 6 is an enlarged schematic drawing of a part of the roll paper unit.

FIG. 6 is an enlarged schematic drawing of a part of roll paper unit 70, in which the same symbols and numerals are used as in FIGS. 3 and 4 for the corresponding constitution elements. Since the respective constituting elements are shown schematically with enlargement in FIG. 6, some of the constituting elements are shown in somewhat different shape from FIGS. 3 and 4.

When roll paper unit 70 is incorporated into the main body of copying machine 10, main body guide plate 66 is closed, and first outlet guide plate 67 and second outlet guide plate 92 are in contact with each other. Thereby, second outlet guide plate 92 is forced to turn around pivot 92*a* in the arrow-G direction to the position shown by two-dot chain line. Second outlet guide plate 92 presses down, by rear end portion 92*b* thereof, tip portion 80*c* of guide plate 80, whereby guide plate 80 at the position shown by a solid line is turned around central shaft 80*d* in the arrow-H direction to the position shown by the two-dot chain line. Thus the path shown by the arrow C is closed, and the path shown by the arrow F is opened to deliver roll paper 72 in the paper feed direction.

Second outlet guide plate 92 is energized by a coil spring (not shown in the drawing) to turn counterclockwise in the drawing paper face of FIG. 6. Guide plate 80 is also energized by a coil spring (not shown in the drawing) to turn clockwise in the drawing paper face of FIG. 6. Thereby, when roll paper unit 70 is demounted from the main body of copying machine 10, second outlet guide plate 92 and guide plate 80 turn in the direction reverse to that mentioned above to close the path of the arrow-F direction and to open the path of the arrow-C direction, whereby roll paper 72 is delivered to the discharge direction. In this embodiment, guide plate 80 and second outlet guide plate 92 constitute the switching member as called in the present invention. In the state in which the path in the arrow-F direction is open, protrusion 92*c* of second outlet guide plate 92 is actually in contact with guide plate 80. In FIG. 6, however, protrusion 92*c* is shown to be apart from guide plate 80 to demonstrate clearly the movement of guide plate 80 and second outlet guide plate 92.

Cutter 100 is provided for cutting roll paper 72 near cutter lower blade guide 78 in the downstream side thereof. This cutter 100 is ordinarily placed in a waiting position apart from the both ends in the breadth direction of roll paper 72 not to hinder the passage of roll paper 72.

In roll paper unit 70, cutter 100 is constituted to move in the direction perpendicular to the drawing paper face of FIG. 6 to cut roll paper 72 when roll unit 70 is incorporated into copying machine 10 with roll paper 72 extending in the paper discharge direction (arrow-C direction). The position of movement of cutter 100 is the prescribed cutting position in the present invention. The front end portion of roll paper 72 having been cut by cutter 100 is discharged through discharge outlet 102 as shown in FIG. 4.

The shape of the surface 80*a* of guide plate 80 is explained by reference to FIG. 7.

Figure 7:
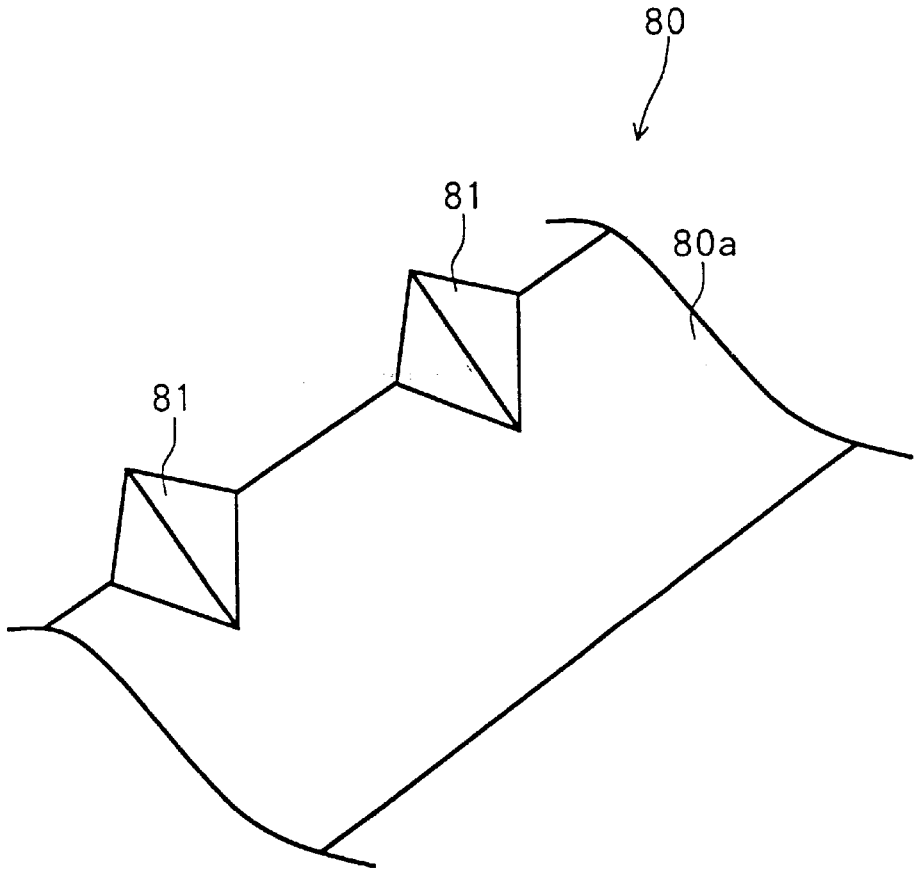
FIG. 7 is a perspective view of a part of the upper face of a guide plate.

FIG. 7 is a perspective view of a part of upper face 80*a* of guide plate 80.

Guide plate 80 has many protrusions 81 at a prescribed intervals on the face 80*a* from the middle portion to the front side (downstream side in paper discharge direction). Face 80*a* of guide plate 80 is in a wave shape. This guide plate 80 guides roll paper 72 in the paper discharge direction to the tops of protrusions 81. Thereby the delivery direction can be switched selectively to the paper discharge direction or to the paper feed direction at a smaller turning angle of guide plate 80. The smaller turning angle of the guide plate saves the space. Instead of protrusions 81, guide plate 80 may made thicker.

Another roll paper unit 200 different a little from the above roll paper unit 70 is explained by reference to FIGS. 8–12.

Firstly, roll paper unit 200 incorporated into or demounted from the main body of copying machine 10 is explained by reference to FIGS. 8 and 9.

Figure 8:
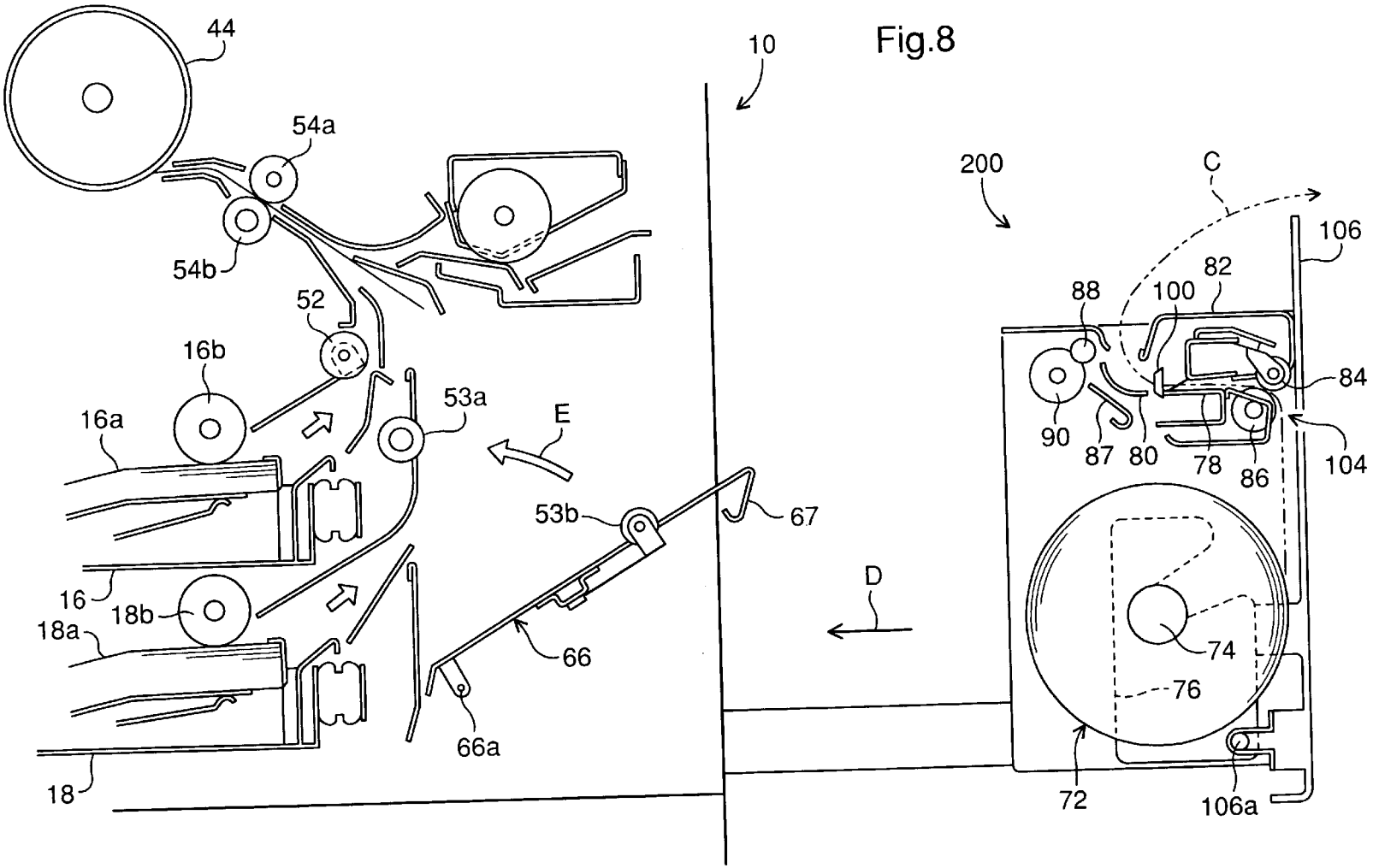
FIG. 8 is a schematic drawing of a roll unit of another embodiment.

FIG. 8 is a schematic view of roll paper unit 200 demounted from the main body of copying machine 10. FIG. 9 is a schematic view of roll paper unit 200 incorporated into the main body of copying machine 10. In these drawings, the same symbols and numerals are used as in FIGS. 2–7 for the corresponding constitution elements.

Roll paper 72 set on spool 74 is placed in roll unit 70 with the both ends of the spool held rotatably by spool holder 76. In a state of roll paper unit 200 demounted from the main body of copying machine 10, roll paper 72 is guided by cutter lower blade guide 78, face 80*a* of guide plate 80 and upper stay 82 to the paper discharge direction (shown by an arrow C) to reach paper discharge outlet 102. In this state, press roller 84 and paper feed roller (driving roller) 86 for delivering roll paper 72 are apart from each other. Also in this state, guide plate 66 of the main body is opened, and delivery rollers 53*a*, 53*b* which deliver cut paper 18*a*, etc. from cassette 18, 20, or 22 (cassette 20 and 22 are not shown in FIG. 8) are apart from each other. Cutter 100 is provided near cutter lower blade guide 78 to cut roll paper.

Figure 9:
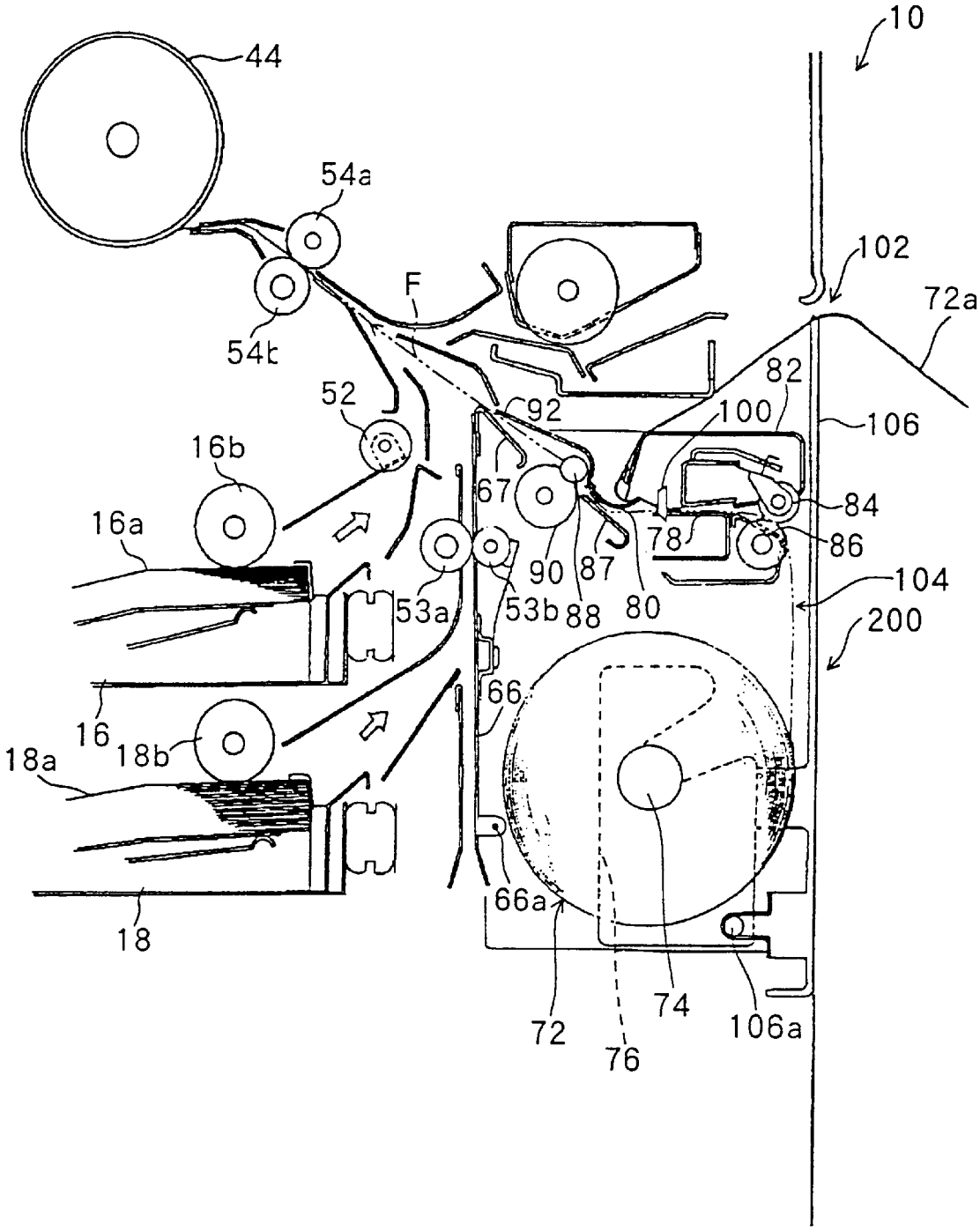
FIG. 9 is a schematic drawing of the state of the roll paper unit shown in FIG. 8 incorporated into the main body of the copying machine shown in FIG. 1.

On the other hand, when roll paper unit 200 of FIG. 8 is pushed in the arrow-D direction for incorporation into the main body of copying machine 10 as shown in FIG. 9, guide plate 66 of the main body is turned around pivot 66*a* in the arrow-E direction for closure. At the top end portion of main body guide plate 66, first outlet guide plate 67 is provided which extends obliquely downward and outward.

By incorporation of roll paper unit 200 into the main body of copying machine 10, second outlet guide plate 92 is forced to turn by contact with first outlet guide plate 67, and guide plate 80 also is also turned. Thereby, roll paper 72 is led through cutter lower blade guide 78 placed above roll paper 72, back face 80*b* of guide plate 80, and swing guide 87 in a paper delivery direction (arrow-F direction) to be gripped between press roller 88 and curl-taking roller (driving roller) 90. Press roller 88 is made of a metal, and curl-taking roller 90 has a peripheral face made of a sponge. In this state of incorporation, press roller 84 and paper feed roller 86 (driving roller) for delivering roll paper 72 are in contact with each other, and roll paper 72 is delivered in the paper feed direction by rotating paper feed roller 86 and curl-taking roller 90. Roll paper unit 200 has aperture 104 for setting roll paper 72. This aperture 104 is closed and opened by roll paper cover 106 turning around pivot 106*a*.

Figure 11:
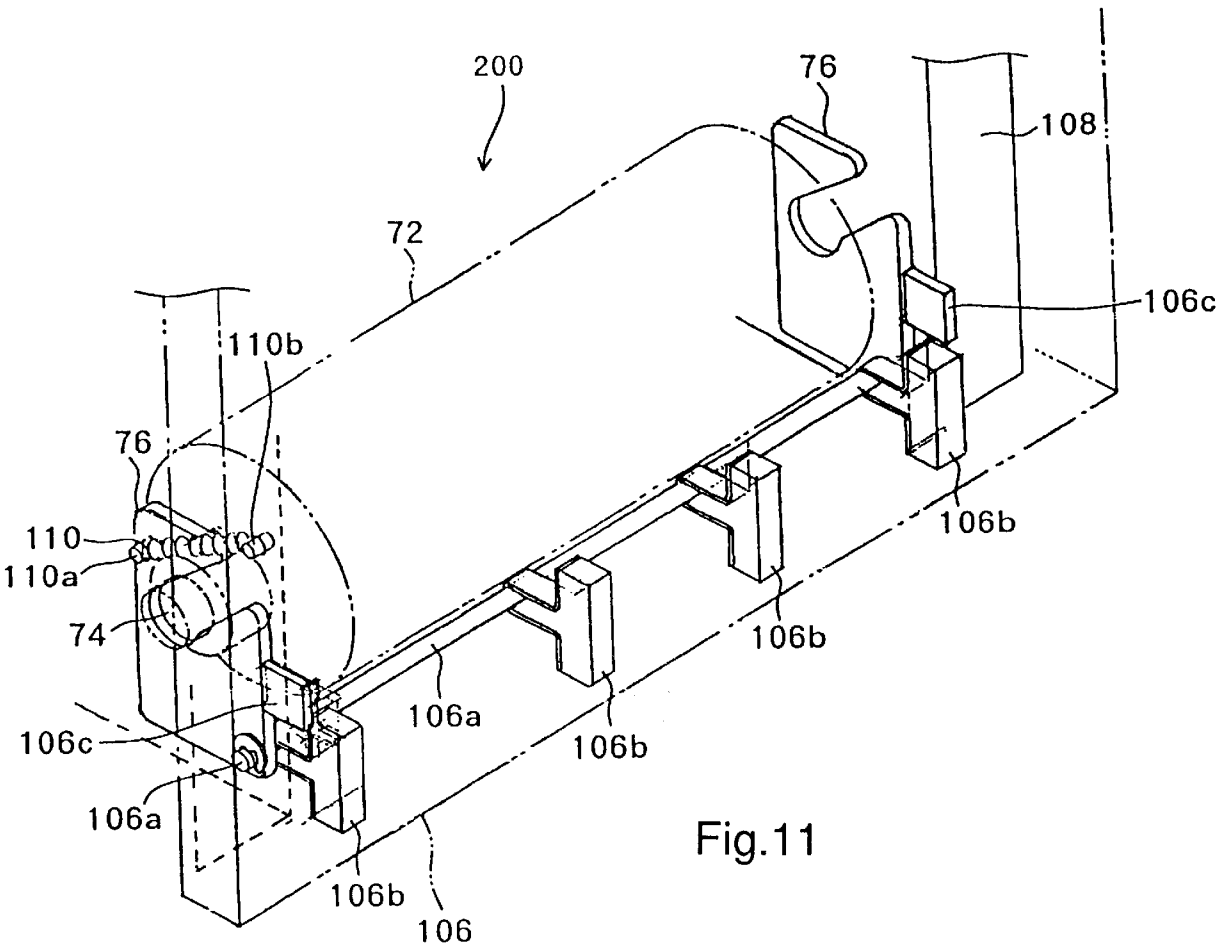
FIG. 11 is a schematic drawing of the spool holder shown in FIG. 8 and a roll paper set rotatably to the spool holder.
Figure 12:
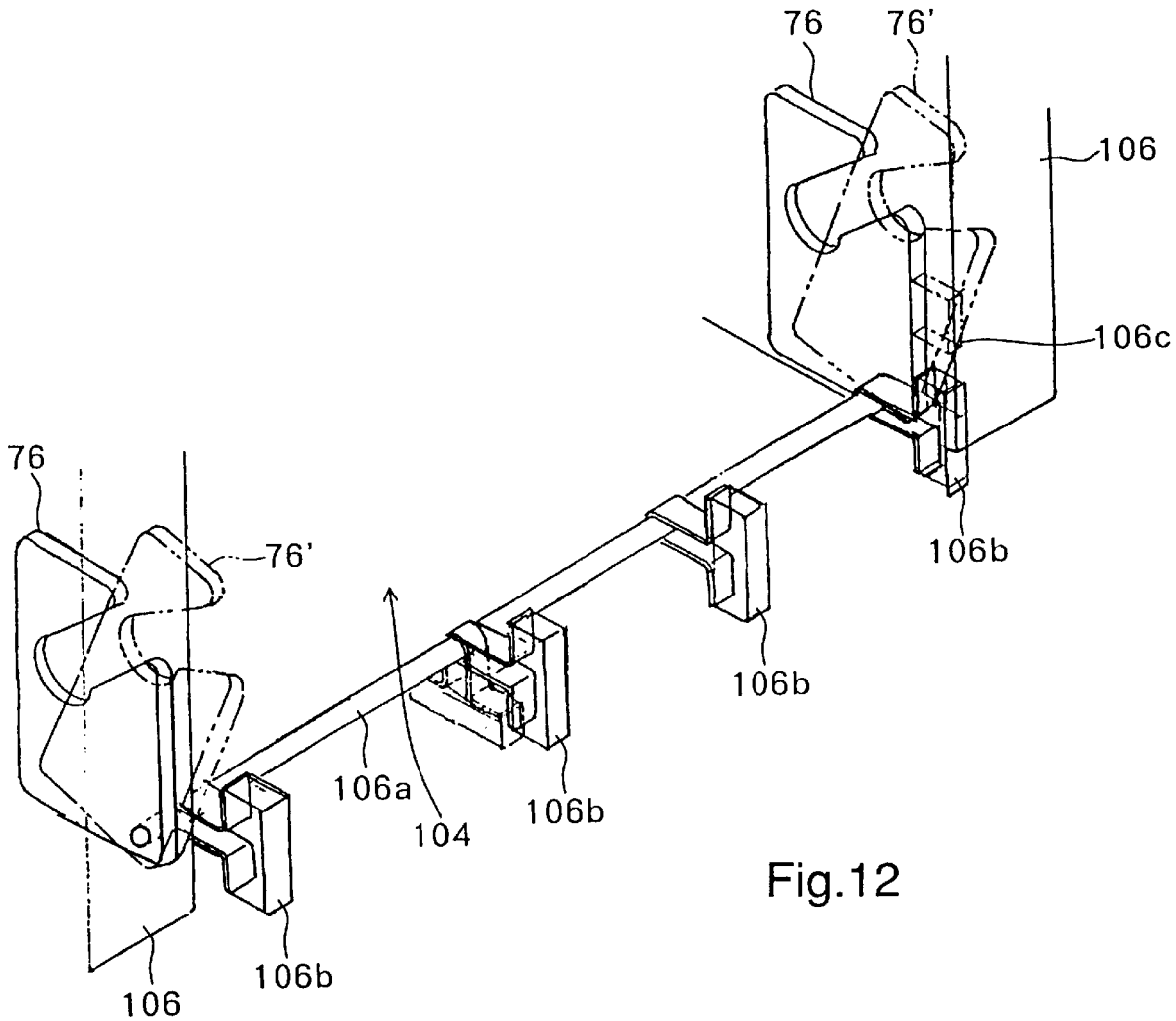
FIG. 12 is a schematic drawing showing the state of turning of the spool holder of the roll paper unit shown in FIG. 8.

The structure of the roll paper unit is explained below by reference to FIGS. 10, 11, and 12.

Figure 10:
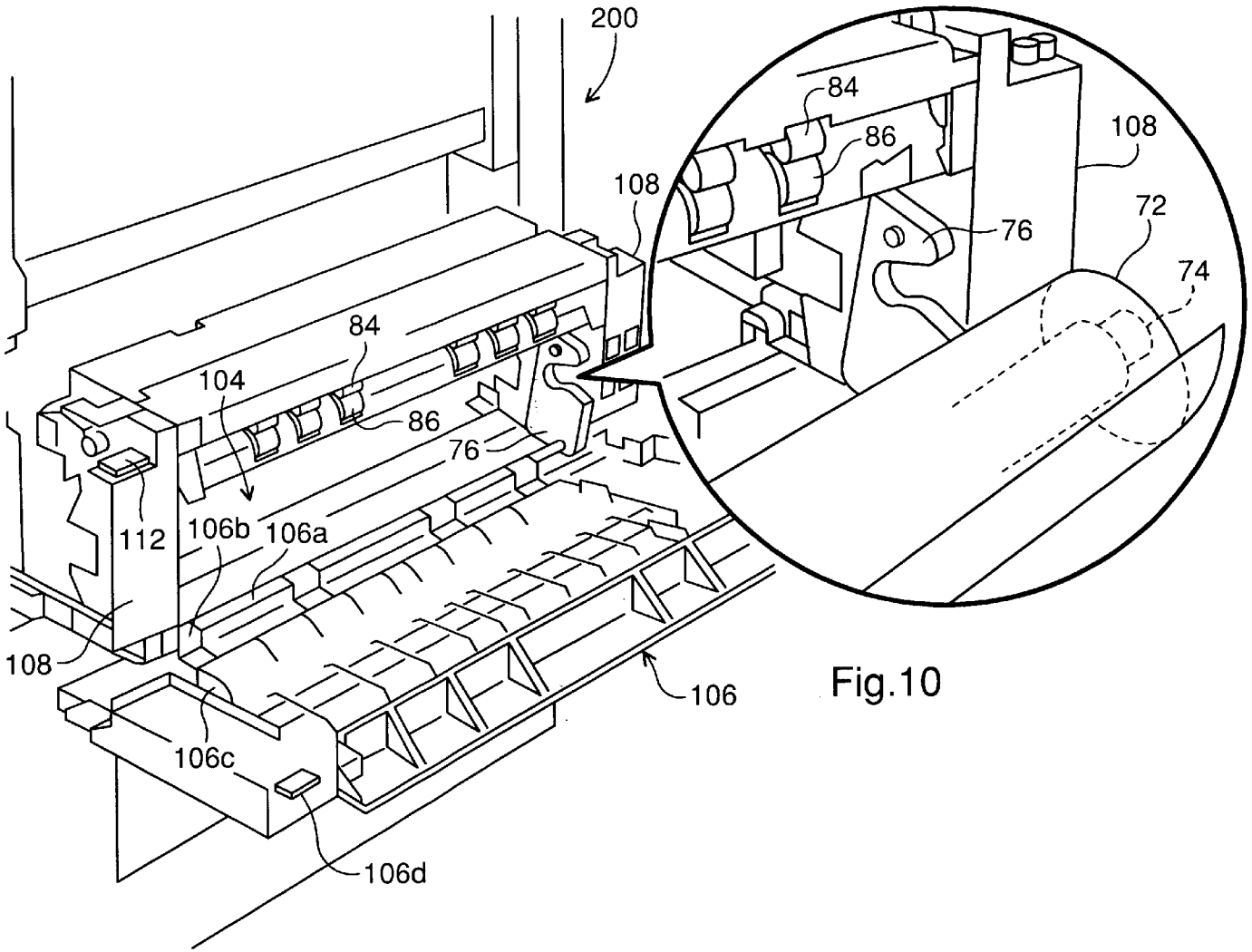
FIG. 10 is a perspective view of a state of the roll paper unit shown in FIG. 8 with the roll paper cover opened.

FIG. 10 is a perspective view of a state of roll paper unit 200 demounted from the main body with roll paper cover 106 opened. FIG. 11 is a perspective view showing schematically spool holder 76 and a roll paper 72 held rotatably by this spool holder 76. FIG. 12 is a perspective view showing the state of turning of spool holder 76. In these drawings, the same symbols and numerals are used as in FIGS. 8 and 9 for the corresponding constitution elements.

This paper roll unit 200 is characterized by spool holder 76 turned around pivot 106*a* by opening or closing of roll paper cover 106. When roll paper cover 106 is opened, spool holder 76 is in a position for easy takeout of spool 74 (an example of the takeout position in the present invention). This takeout position shown in FIG. 10 by the position of spool holder 76, and in FIG. 12 by the position of spool holder 76' indicated by two-dot chain line. On the other hand, when roll paper cover 106 is closed, spool holder 76 is in a position where both ends of spool 74 is held rotatably by spool holder 76 to feed roll paper 72 (an example of paper feed position in the present invention). This paper feed position is shown in FIG. 11 by the position of spool holder 76, and in FIG. 12 by the position of spool holder 76 indicated by a solid line.

Roll paper unit 200 has a pair of side walls 108 extending in the direction perpendicular to spool 74 at the both sides of aperture 104. Spool holders 76 are placed in contact with the inside faces of the pair of side walls 108. One end 110a of pulling coil spring 110 is connected to spool holder 76 at upper portion remote from aperture 104 as shown in FIG. 11. The other end 110b of this pulling coil spring 110 is connected to side wall 108. Thereby, spool holder 76 is energized to turn around pivot 106*a* from the aforementioned feed position to the takeout position.

On the upper faces of a pair of side walls 108, magnets 112 is fixed respectively (an example of the fixing member in the present invention). On the upper face thereof respectively, a long slit (not shown in the drawing) is formed which extends in a direction nearly perpendicular to the length direction of spool 74, and magnet 112 is fixed through the long slit to side wall 108 by a bolt or the like. By loosening the bolt, magnet 112 can be displaced arbitrarily in the direction nearly perpendicular to the length direction of spool 74, and can be fixed at a desired position in the slit. Magnets 112 attracts metal plates 106*d* fixed to roll paper cover 106 to keep the closed roll paper cover 106 fixed to side walls 108. Therefore, the position of fixation of roll paper cover on side walls 108 can be changed correspondingly with the fixation position of the two magnets 112.

Roll paper cover 106, when fixed to side wall 108, pushes spool holder 76 as described later. Therefore, the paper feed position of spool holder 76 can be changed by changing the positions of magnets 112 to change the pushing distance of spool holder 76. Thus, spool 74 can be placed perpendicularly to the paper feed direction by changing the paper feed position of spool holder 76. In assemblage of the apparatus in the factory, the paper feed position of spool holder 76 can be guaranteed by adjusting the fixation position of two magnets 112 to prevent oblique movement of roll paper 72 fed from roll paper unit 200.

Roll paper cover 106 is provided with four turning members 106*b* fixed rotatably to opening shaft 106*a*, and can be turned together with these turning members 106*b* around opening shaft 106*a* to open and close the aperture 104. On the back face of roll paper cover, protrusion 106*c* is formed respectively at the middle points of both ends thereof. When roll paper cover is opened, spool holder is at the takeout position by the force of pulling coil spring 110. On the other hand, when roll paper cover 106 is closed, protrusions 106c push spool holder 76 to move spool holder 76 from takeout position to paper feed position. On complete closure of the roll paper cover 106, spool holder is set at the feed position. In such a manner, spool holder 76 moves between the takeout position and the paper feed position with the opening and closing operation of roll paper cover 106, whereby spool 74 can be set or removed readily to hold roll paper 72 in roll unit 200.

Still another roll paper unit 300 different a little from the above roll paper unit 70 or 200 is explained by reference to FIGS. 13, 14, and 15.

Figure 13:
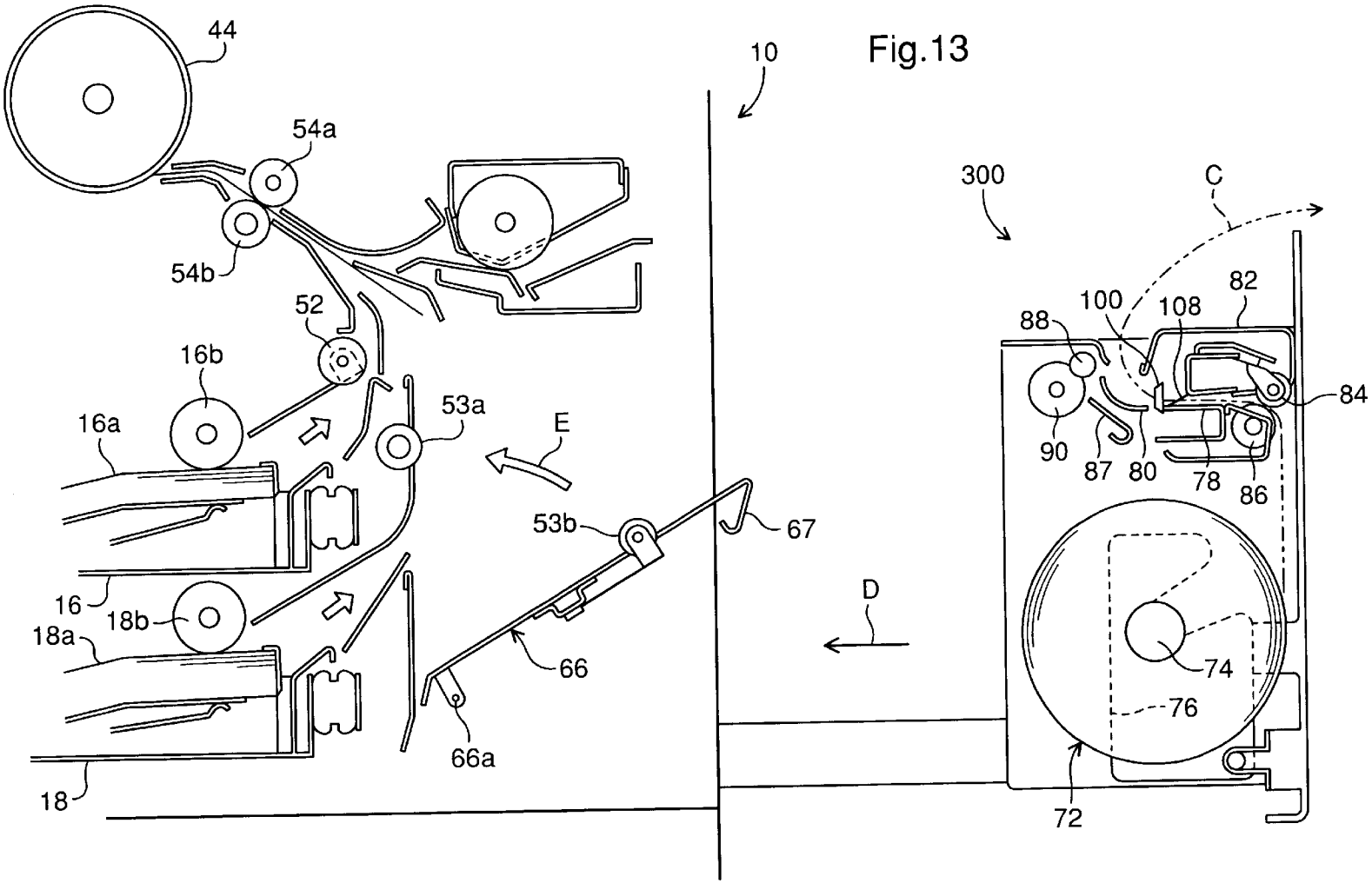
FIG. 13 is a schematic drawing of another embodiment of the roll paper unit.

FIG. 13 is a schematic drawing of roll paper unit 300 demounted from the main body of copying machine 10. FIG. 14 is a schematic drawing of roll paper unit 300 incorporated into the main body of copying machine 10. In these drawings, the same symbols are used as in FIGS. 2–5 for the corresponding constitution elements.

Roll paper 72 set on spool 74 is placed in roll unit 300 with the both ends of the spool held rotatably by spool holder 76. As shown in FIG. 13, in a state of roll paper unit 300 demounted from the main body of copying machine 10, roll paper 72 is guided by cutter lower blade guide 78 (an example of the guide plate in the present invention), surface 80*a* (see FIG. 15) of guide plate 80, and upper stay 82 which are placed above roll paper 72 to the paper discharge direction (shown by an arrow C).

In this state, press roller 84 and paper feed roller (driving roller) 86 for delivering roll paper 72 are kept apart from each other. Also in this state, main body guide plate 66 is opened, and delivery rollers 53*a*,53*b* which deliver cut paper 18*a* or the like from cassette 18, 20, or 22 (cassettes 20 and 22 are not shown in FIG. 13) are kept apart from each other. Cutter 100 is provided for cutting roll paper 72 near cutter lower blade guide 78 in the downstream side thereof. Further, flexible plate-shaped member 108 is provided above the cutter lower blade guide plate 78. This plate-shaped member 108 made of a polyester film is described later by reference to FIGS. 15 and 16.

Figure 14:
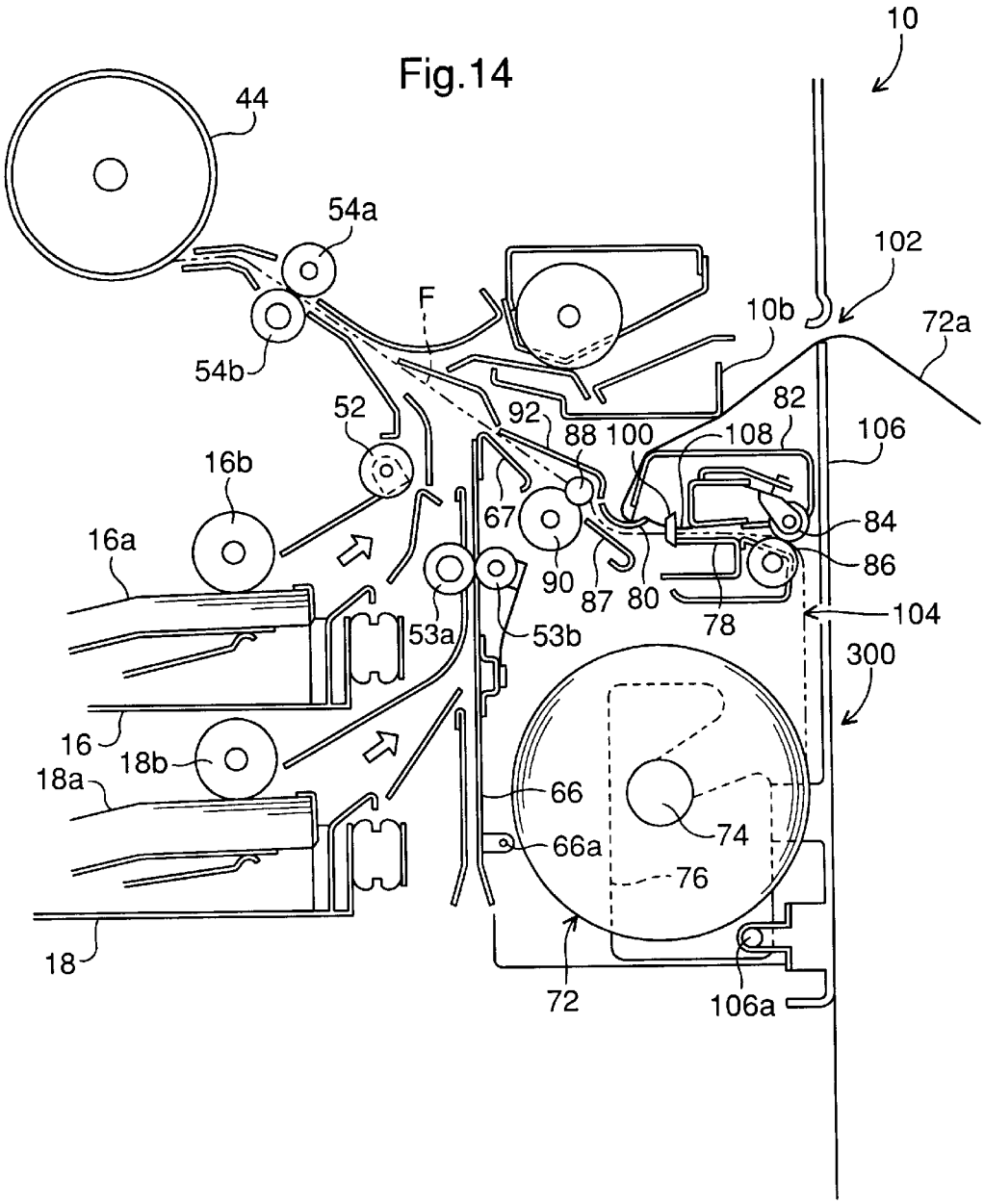
FIG. 14 is a schematic drawing showing the state of the roll paper unit shown in FIG. 13 incorporated into a main body of the copying machine.

On the other hand, when roll paper unit 300 of FIG. 13 is pushed in the arrow-D direction for incorporation into the main body of copying machine 10 as shown in FIG. 14, main body guide plate 66 turns around pivot 66*a* in the arrow-E direction for closure. At the top end portion of main body guide plate 66, first outlet guide plate 67 is provided which extends obliquely downward and outward.

By incorporation of roll paper unit 300 into the main body of copying machine 10, second outlet guide plate 92 is turned by contact with first outlet guide plate 67, and guide plate 80 also is also turned. Thereby, roll paper 72 is led through cutter lower blade guide 78 placed above roll paper 72, back face 80*b* of guide plate 80, and swing guide 87 in a paper delivery direction (arrow-F direction) to be held between press roller 88 and curl-taking roller (driving roller) 90. Press roller 88 is made of a metal, and curl-taking roller 90 has a peripheral face made of a sponge.

In this state of incorporation of roll paper unit 300 into the main body of copying machine 10, press roller 84 and paper feed roller (driving roller) 86 are in contact with each other, and by rotating paper feed roller 86 and curl-taking roller 90, roll paper 72 is delivered in the paper feed direction. The roll paper unit 300 has aperture 104 for placing roll paper 72 therein. This aperture 104 is closed and opened by roll paper cover 106 which turns around pivot 106*a*.

As described later by reference to FIG. 15, by incorporation of roll paper unit 300 into the main body of copying machine 10, second outlet guide plate 92 is turned by contact with first outlet guide plate 67, and guide plate 80 also is also turned. Thereby, roll paper 72 is lead in a paper delivery direction (arrow-F direction) through cutter lower blade guide 78, back face 80*b* of guide plate 80 (see FIG. 15), and swing guide 87 which are placed above roll paper 72 to be held between press roller 88 and curl-taking roller (driving roller) 90. Press roller 88 is made of a metal, and curl-taking roller 90 has a peripheral face made of a sponge. In this state of incorporation, press roller 84 and paper feed roller (driving roller) 86 for delivering roll paper 72 are in contact with each other. Roll paper 72 is delivered in the paper feed direction by rotation of paper feed roller 86 and curl-taking roller 90.

The delivery and cutting of roll paper 72 is explained by reference to FIG. 15.

Figure 15:
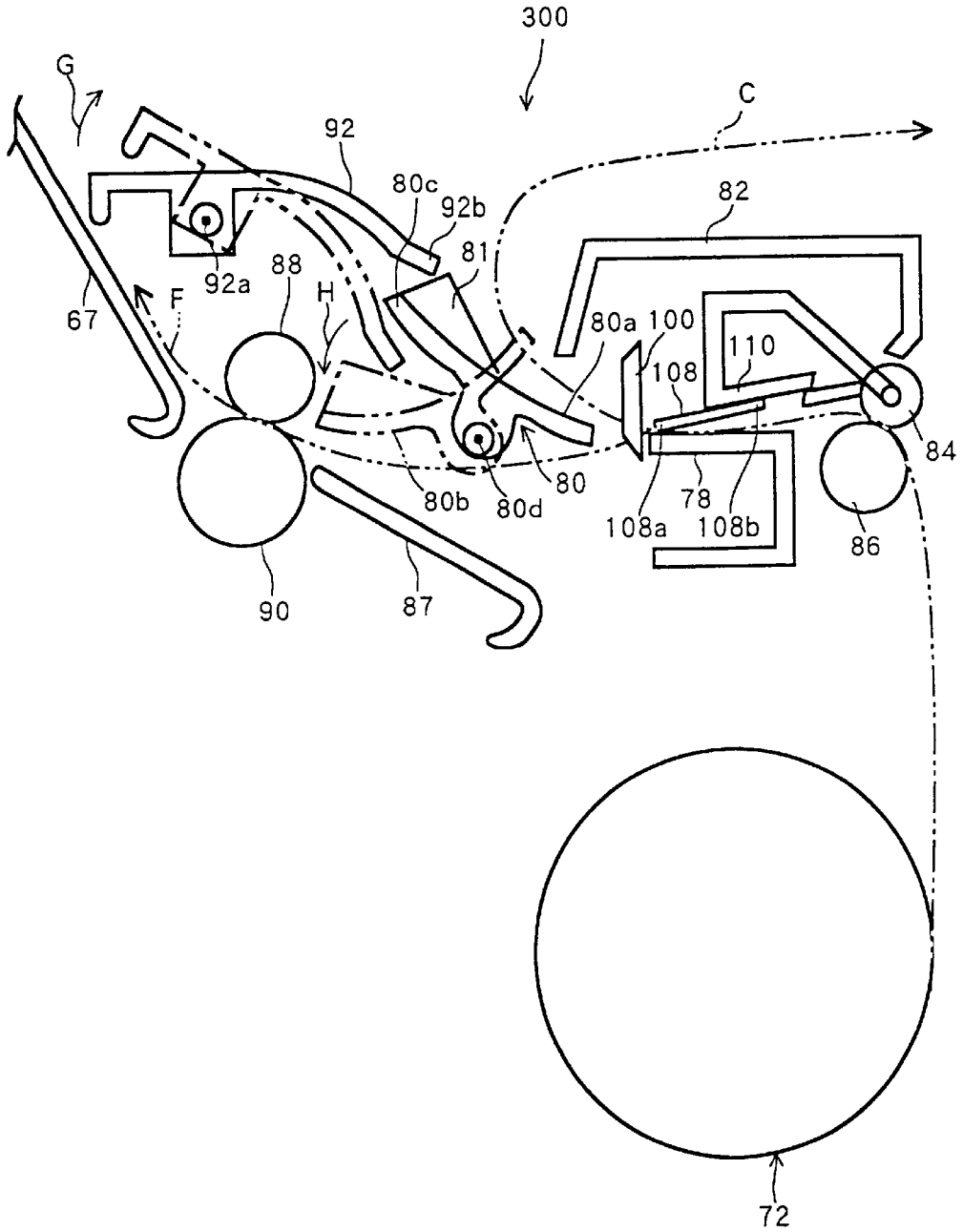
FIG. 15 is an enlarged schematic drawing of a part of the roll paper unit shown in FIG. 13.

FIG. 15 is an enlarged schematic drawing of a part of roll paper unit 300, in which the same symbols or numerals are used as in FIGS. 13 and 14 for the corresponding constitution elements. Since the respective constituting elements are shown schematically with enlargement, some of the constituting elements shown are in somewhat different shape from FIGS. 13 and 14.

When roll paper unit 300 is incorporated into the main body of copying machine 10, main body guide plate 66 is closed, and first outlet guide plate 67 and second outlet guide plate 92 are in contact with each other. Thereby, second outlet guide plate 92 turns around pivot 92*a* in the arrow-G direction to the position shown by two-dot chain line. Second outlet guide plate 92 presses down, with rear end portion 92*b* thereof, tip portion 80c of guide plate 80, whereby guide plate 80 at the position shown by a solid line turns around central shaft 80*d* in-the arrow-H direction to the position shown by the two-dot chain line. Thus the path shown by the arrow C is closed, and the path shown by the arrow F is opened to allow roll paper 72 to be delivered in the paper feed direction.

When roll paper unit 300 is demounted, second outlet guide plate 92 and guide plate 80 turn in the direction reverse to that mentioned above to close the path of the arrow-F direction and to open the path of the arrow-C direction, whereby roll paper 72 is delivered to the discharge direction.

Cutter 100 is provided for cutting roll paper 72 near cutter lower blade guide 78 in the downstream side thereof. This cutter 100 is normally placed in a waiting position apart from the both ends in the breadth direction of roll paper 72 not to hinder the passage of roll paper 72. In roll paper unit 300, cutter 100 is constituted such that cutter 100 moves in the direction perpendicular to the drawing paper face of FIG. 15 (direction of the breadth of roll paper 72) to cut roll paper 72 when roll unit 70 is incorporated into copying machine 10 with roll paper 72 extending in the paper discharge direction (arrow-C direction). The position of movement of cutter 100 is the prescribed cutting position as called in the present invention. The front end portion 72*a* of roll paper 72 having been cut by cutter 100 is removed through discharge outlet 102 as shown in FIG. 14.

As mentioned above, flexible plate-shaped member 108 made of a polyester film is provided above the cutter lower blade guide plate 78. One end portion 108*a* of plate-shaped member 108 presses lightly cutter lower blade guide plate 78, and the other end portion 108*b* is fixed to upper guide 110. Thereby, roll paper 72 passing cutter lower blade guide plate 78 is pressed by the flexible plate-shaped member 108 against cutter lower blade guide plate 78, which enables precise cutting of roll paper 72 by scanning with cutter 100.

After the cutting of roll paper 72 with cutter 100, roll paper 72 is moved back and forth with pressing the paper by flexible plate-shaped member 108 against cutter lower blade to detect the front end of roll paper 72. In this operation, the resistance to movement of roll paper 72 is kept low since plate-shaped member 108 is not made of a metal plate or the like and is flexible, so that the to-and-fro movement of roll paper is not hindered by plate-shaped member 108 kept there. With such a constitution of roll paper unit 300 that flexible plate-shaped member 108 presses roll paper 72 against cutter lower blade plate 78, roll paper 72 can be cut precisely by cutter 100 with simple constitution, and can be smoothly moved back and forth without hindrance of the movement of roll paper 72.

The external appearance of plate-shaped member 108 is explained by reference to FIG. 16.

Figure 16:
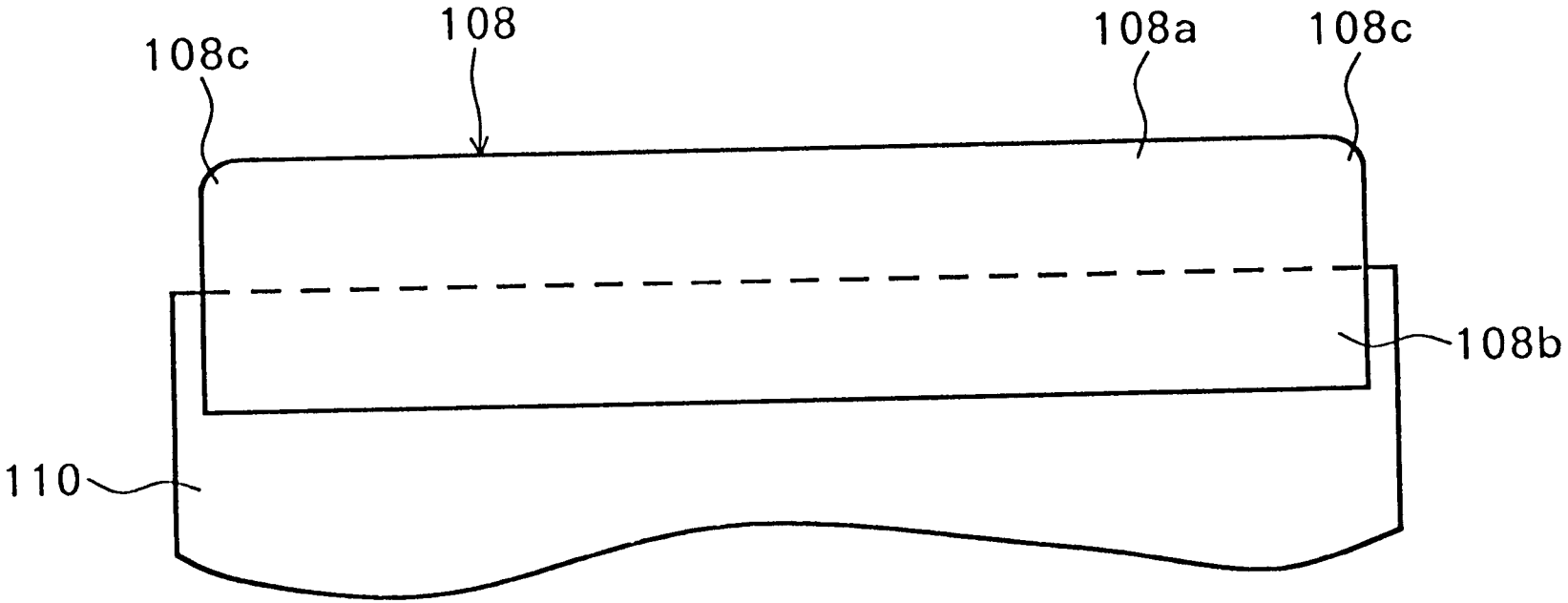
FIG. 16 is a schematic drawing of a plate-shaped member viewed from the bottom side.

FIG. 16 is a schematic drawing of plate-shaped member 108 viewed from the bottom.

Plate-shaped member 108 is nearly rectangular in its shape. Both ends 108*c* of one side portion 108*a* is rounded. In FIG. 16, the plate-shaped member 108 is shown as one rectangular plate, but it may be constituted of plural divided plates.

Still another paper roll unit 400 different a little from the above roll paper units 70, 200, and 300; a pair of delivery rollers 53*a*,53*b*; press roller 84 and paper feed roller (drive roller) 86 for delivery of roll paper 72; and opening of the paper feed delivery path for delivering cut paper sheets from the cassette are explained by reference to FIGS. 17, and 18.

Figure 17:
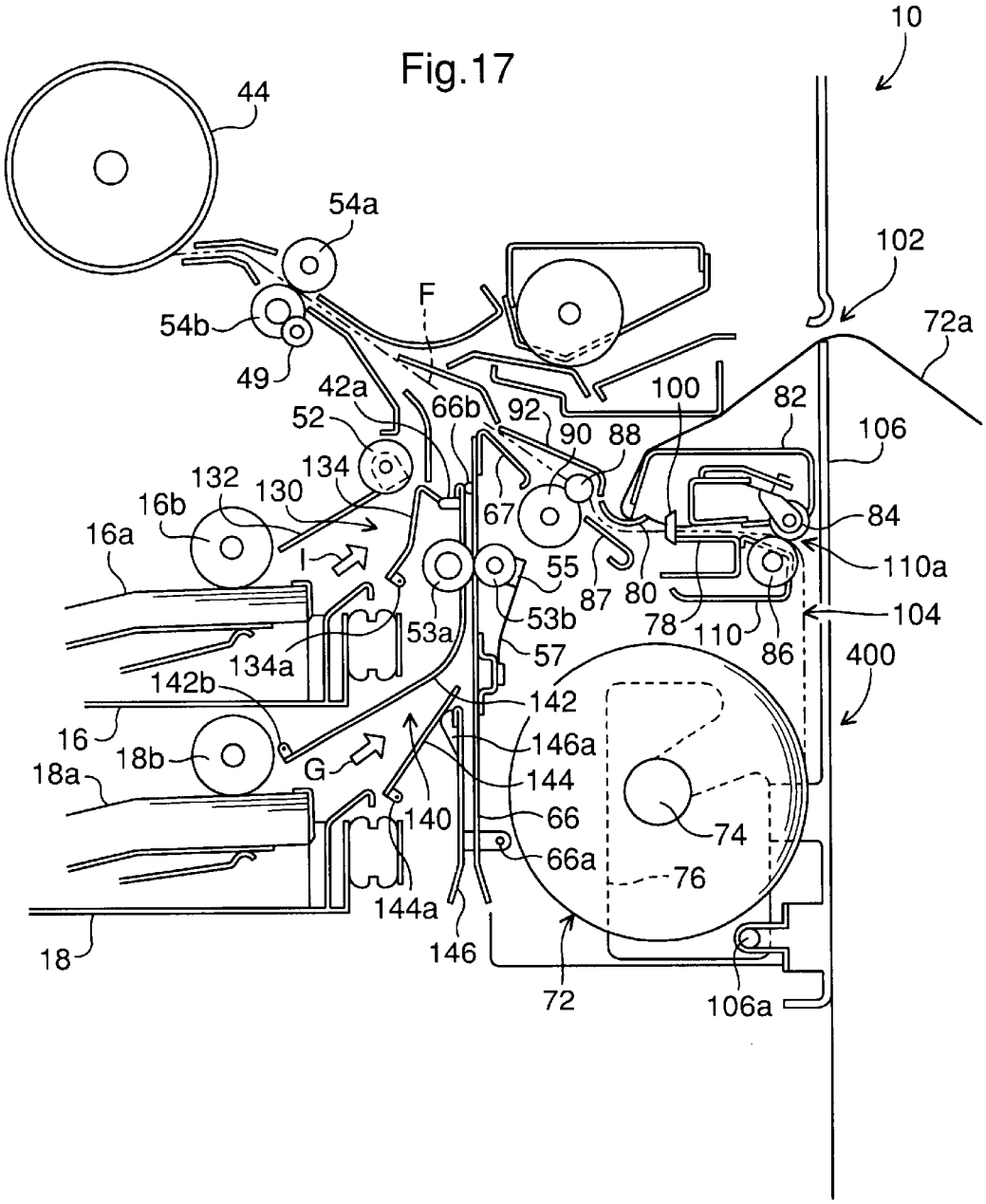
FIG. 17 is a schematic drawing showing the state of the roll paper unit of another embodiment incorporated into the main body of the copying machine shown in FIG. 1.

FIG. 17 is a schematic drawing of roll paper unit 400 incorporated into the main body of copying machine 10. FIG. 18 is a schematic drawing of roll unit 400 demounted from the main body of copying machine 10. In these drawings, the same symbols and numerals are used as in FIG. 2 for the corresponding constitution elements.

Roll paper 72 set on spool 74 is placed in roll unit 400 with the both ends of the spool held rotatably by spool holder 76. As shown in FIG. 17, in a state of roll paper unit 400 incorporated into the main body of copying machine 10, main-body guide plate 66 is closed by turning around pivot 66*a* in the arrow-E direction (see FIG. 18). On main-body guide plate 66 has an opening through which a part of delivery roller 53*b* protrudes. Delivery roller 53*b* is held rotatably by roller supporting member 55. This roller supporting member 55 is fixed at one end portion 57*a* of plate spring 57, and the other end portion 57*b* of plate spring 57 is fixed to main-body guide plate 66 by bolt 57*c* or the like. As shown in FIG. 17, in a state of roll paper unit 400 incorporated into the main body of copying machine 10, delivery roller 53*b* is pressed against delivery roller 53*a* to grip the cut paper sheet therebetween.

Figure 18:
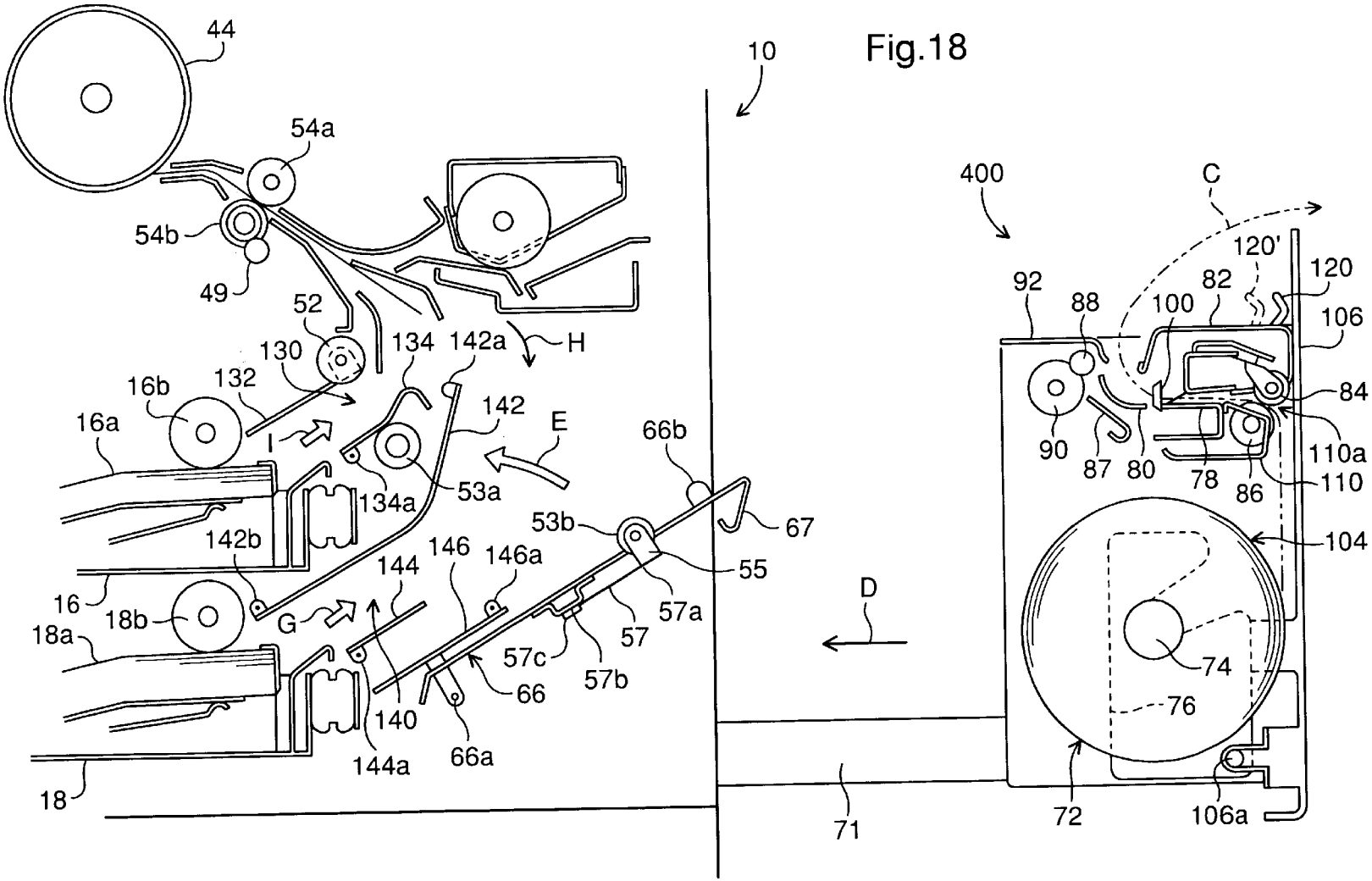
FIG. 18 is a schematic drawing showing a state of a roll paper unit of FIG. 17 demounted from the main body of the copying machine shown in FIG. 1.
Figure 19:
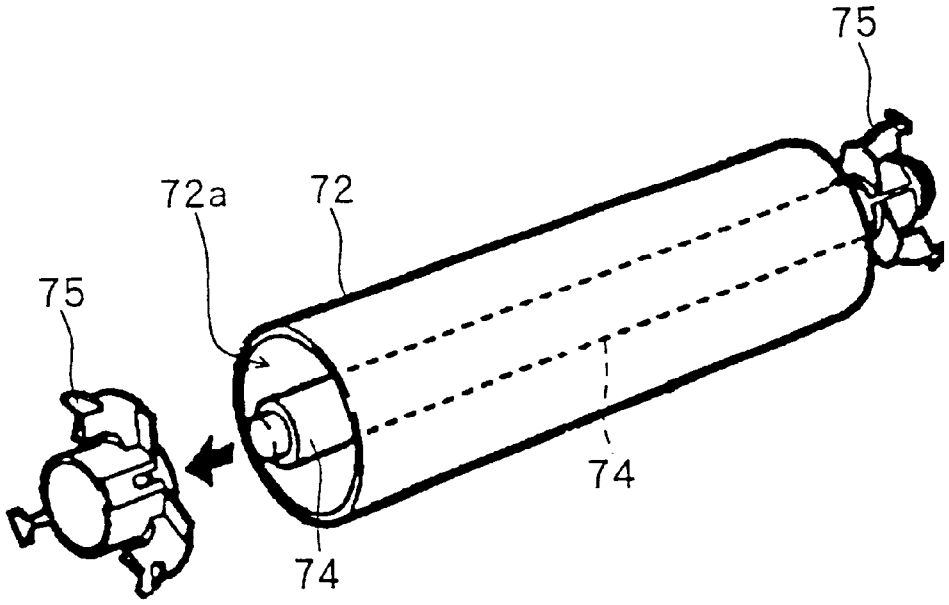
FIG. 19 is a schematic perspective view of a roll paper and a bar-shaped spool having the roll paper set thereon.

When paper jam has occurred during feed of cut paper sheets 16*a*,18*a*,20*a*,22*a* from cassettes 16,18,20,22, or feed of roll paper 72 from roll paper unit 400, roll paper unit 400 is drawn out in the direction opposite to the arrow-D direction from main body 10 (see FIG. 18).

In this apparatus, roll paper unit 400 is supported by rail 71 fixed to the side plate of the main body enabling easy demounting of roll paper unit 400, whereby handling of jamming paper in the roll paper unit can be treated simply.

Further in this apparatus, registration rollers 54*a*,54*b* are constituted of upper roller 54*a* made of rubber and lower roller 54*b* made of a metal, and are fixed rotatably on a side plate before the paper feed and a side plate after paper feed. Lower roller 54*b* is engaged with paper feed drive by a electromagnetic clutch on the back side. Recording paper sheets are delivered to the image transfer region by engaging the magnetic clutch in correspondence with the optical system in image reading device to rotate registration roller 54*a*, 54*b*.

Registration rollers 54*a*,54*b* have a shaft respectively penetrating the side plate before paper feed, and a gear is fixed respectively to the shafts. A one-way gear 49 (an example of reverse rotation-preventing member in this invention) engaging with the lower roller allows the roller to rotate in one direction only. Therefore, registration rollers 54*a*,54*b* rotate in the direction only of recording paper delivery. Therefore, in the case where jamming occurs during roll paper delivery and roll paper unit 400 is demounted, registration. rollers 54*a*,54*b* engaging with one-way gear 49 will not rotate reversely, allowing unwinding of roll paper from roll paper unit 400. Consequently, the portion carrying an unfixed transferred image is not reversely delivered even when rolled unit 400 is demounted, which prevents soiling, with an unfixed toner, of registration rollers 54*a*,54*b* and paper the delivery path positioning at the upstream side of the image transfer region.

On the other hand, in the state of roll paper unit 400 demounted from copying machine 10 as shown in FIG. 18, a pair of roller 53*a*,53*b* are apart from each other, whereby delivery roller 53*b* protrude more from main-body guide plate 66. At the top end of this main-body guide plate 66, first outlet guide plate 67 is formed to extend obliquely outward and downward.

Cut paper sheet 16*a* stored in cassette 16 is delivered in the arrow-I direction through paper delivery path 130 to registration rollers 54*a*,54*b*. Paper delivery path 130 is formed by first guide plate 132 and second guide plate 134. Second guide plate 134 is energized by a coil spring or the like (not shown in the drawing) to turn around pivot 134*a* in the arrow-H direction. However, in the state of roll paper unit 400 incorporated, it is pushed by projection 142*a* formed at the both end portion of third guide plate 142 in the arrow-E direction opposite to the arrow-H direction to take the position (as shown in FIG. 17) to form paper feed path 130.

Cut paper sheet 18*a* stored in cassette 18 is delivered in the arrow-G direction through paper feed path 140 to registration rollers 54*a*,54*b*. Paper delivery path 140 is formed by third guide plate 142 and fourth guide plate 144. Third guide plate 142 is energized by a coil spring (not shown in the drawing) to turn around pivot 142*b* in the arrow-H direction. However, in roll paper unit 400 in the incorporated state, it is pushed in the arrow-E direction opposite to the arrow-H direction by projections 66*b* formed at the both ends of main-body guide plate 66 to be at the position to form paper delivery path 140 (the position shown in FIG. 17).

Fourth guide plate 144 is energized by a coil spring (not shown in the drawing) to turn around pivot 144*a* in the arrow-H direction. However, in roll paper unit 400 in the incorporated state, it is pushed in the arrow-E direction opposite to the arrow-H direction by projections 146*a* formed at the both ends of auxiliary plate 146 to be at the position to form paper delivery path 140 (the position shown in FIG. 17).

On the other hand, as shown in FIG. 18, in roll paper unit demounted from copying machine 10, auxiliary plate 146 opens with opening of main-body guide plate 66, whereby third guide plate 142 having been pushed by projections 66*b* and fourth guide plate 144 having been pushed by projections 146*a* turn to the arrow-H direction. Further, second guide plate 134 having been pushed by projections 142*a* also turns in the arrow-H direction. As the results, paper delivery paths 130,140 are opened to make easy the paper jam treatment and the like treatment.

In roll paper unit 400 incorporated into the main body of copying machine 10, roll paper 72 is held and delivered by press roller 84 and paper feed roller (driving roller) 86 through cutter lower blade guide 78, bottom face of guide plate 80, and swing guide 87 in the feed direction (the arrow-F direction). Further, roll paper 72 is held by press roller 88 and curl-taking roller (driving roller) 90, and is guided by first outlet guide plate 67, second outlet guide plate 92, and guide plate 80 to paper feed direction. Press roller 88 is made of a metal, and curl-taking roller 90 has peripheral face wound by a sponge. In the state of the incorporation, press roller 84 and paper feed roller 86 for delivery of roll paper 72 are in contact with each other, and roll paper 72 is delivered in the paper feed direction by rotation of paper feed roller 86 and curl-taking roller 90. Roll paper unit 400 has aperture 104 for placing roll paper 72 therein. This aperture 104 is closed and opened by roll paper cover 106 which turns around pivot 106*a*.

In roll paper unit 400 demounted from the main body of copying machine 10, as shown in FIG. 18, delivery path is formed by cutter lower blade guide 78, the upper face of guide plate 80, and upper stay 82 placed above roll paper 72 for guiding roll paper 72 to the paper discharge direction (arrow-C direction) to deliver roll paper 72 through this delivery path to paper discharge outlet 102. Further, in roller paper unit 400 demounted from the main body of paper unit 400, main-body guide plate 66 is opened, and a pair of delivery roller 53*a*,53*b* for delivering cut paper sheets 16*a*, 18*a*,20*a*,22*a* stored in cassettes 16,18,20,22 (cassettes 20,22 are not shown in FIG. 18) are apart form each other. Thus the pair of delivery rollers 53*a*,53*b* is readily separated by demounting roll paper unit 400 from the main body of copying machine 10, whereby paper jam treatment is facilitated.

Press roller 84 and paper feed roller 86 are disengaged from each other, when roll paper unit 400 is demounted from the main body of copying machine 10, roll paper cover 106 is opened, and lever 120' shown by the two-dotted chain line is pulled to the position 120 shown by the solid line. Cutter 100 for cutting the roll paper is provided near cutter lower blade guide 78. Roll paper unit 400 is incorporated into the main body of copying machine 10 by pushing in the arrow-D direction as shown in FIG. 18.

POSSIBILITY IN INDUSTRIAL APPLICATION

As described above, in the first embodiment of the roll paper unit of the present invention, the switching member switches the roll paper delivery path to the paper discharge direction or to the paper feed direction in correspondence with the state of the roll paper unit, demounted or incorporated. Thus, the roll paper delivery direction is switched corresponding to the state of the roll paper unit. Therefore, the roll paper unit is simple in construction, and is easy in handling.

In the roll paper unit incorporated into the image formation apparatus, in which the front end portion of the roll paper is led out of the image formation apparatus, the front end portion of the roll paper can be removed readily. This type of roll paper unit is more readily handleable.

In the roll paper unit incorporated into the image formation apparatus, in which a cutter for precutting roll paper is provided, the roll paper is precut automatically when the roll paper is lead to paper discharge path, the roll paper is precut automatically. This type of roll paper unit is less laborious in operation.

Further, in the roll paper unit in which the switching member turns in prescribed directions corresponding to the state of the unit, demounted or incorporated, to change the roll paper guiding face of the plate-shaped guide member to the front face side or to the reverse face side, the roll paper guiding face is changed only by turning the guide member, whereby the construction is simplified.

The protrusions formed on at least one of the front face and the reverse face of the plate-shaped guide member for guiding the roll paper enables smaller the thickness of the plate-shaped member.

The first embodiment of the image formation apparatus of the present invention has the above roll paper unit comprising a roll paper cover. Through a slit provided between the roll paper cover and the outside cover of the image formation apparatus, the precut portion of the front end of the roll paper is discharged without providing an additional outlet opening for paper discharge.

In the second embodiment of the roll paper unit of the present invention, the spool holder is moved between a takeout position and a paper feed position with opening or closing movement of a roll paper cover for covering the aperture for setting the roll paper. Thereby, the spool can be readily set or removed, and the roll paper can be readily set in the roll paper unit. Moreover, the constitution for turning the spool holder between the takeout position and the paper feed position can be simplified.

With a fixing member which is set movably in a direction approximately perpendicular to the direction of the spool shaft and fixes the closed roll paper cover to the roll paper unit, the position of the roll cover fixed to the roll paper unit can be shifted by shifting the position of the fixing member. Thereby, the displacement of the spool holder pushed by the roll cover can be changed to shift the paper feeding position of the spool holder to place the spool in the direction perpendicular to the paper feed direction. Consequently, the roll paper is fed without oblique delivery movement from the roll paper unit.

The second embodiment of the image formation apparatus of the present invention has a flexible plate-shaped member for pressing the roll paper against the guide plate. Thereby the cutter cuts the roll paper precisely, and the roll paper is moved smoothly forward and backward with a simple constitution.

The plate-shaped member may be made of a resin film for the low cost and easy handling.

The third embodiment of the image formation apparatus of the present invention has a roll paper unit which is demountable from the main body of the image formation apparatus. Thereby, paper jamming can be treated readily.

The fourth embodiment of the image formation apparatus of the present invention has a delivery path for cut sheets fed from a cassette, whereby jamming of the delivered cut paper sheet can be treated more readily if paper jamming occurs.

In the image formation apparatus which comprises a registration roller for delivering the roll paper at prescribed timing to the image formation section and a reversal-preventing member for preventing reverse rotation of the registration roller, the registration roller rotates only in the paper delivery direction. Therefore, on paper jamming during roll paper delivery by the registration roller, the roll paper unit is demounted and the roll paper is unwound from the roll paper unit without reverse rotation of the registration roller. Therefore, even when the roll paper unit is demounted, the unfixed image-carrying portion in the image transfer section will not be delivered backward from the registration roller, whereby the registration roller and the paper feed delivery path upstream to the image transfer region are not soiled with the unfixed toner.

What is claimed is:

1. In an image forming apparatus having an image formation section for forming an image on roll paper; and a roll paper unit detachable from the image formation section, holding the roll paper, having a cutter to cut the roll paper and feeding the cut roll paper to the image formation section:

said roll paper unit comprising a switching member which switches a paper delivery path to discharge a front portion of the roll paper out of the image forming apparatus when the roll paper unit is detached from the image formation section, and switches the paper delivery path to feed the roll paper to the image formation section when the roll paper unit is attached to the image formation section.

2. The roll paper unit according to claim 1, wherein the front end portion of the roll paper to be precut is drawn out of the image formation apparatus when the roll paper unit is incorporated into the image formation apparatus.

3. The roll paper unit according to claim 2, wherein the roll paper unit has a cutter for precutting the roll paper at a prescribed paper discharge path when the roll paper unit is incorporated into the image formation apparatus.

4. The roll paper unit according to claim 3, wherein the plate-shaped guide member has a protrusion for guiding the roll paper on at least one of the front face and the reverse face thereof.

5. An image formation apparatus comprising the roll paper unit set forth in claim 4, the roll paper unit having a roll paper cover for covering the roll paper unit, and a slit being formed between an outside cover and the roll paper cover for discharging the precut front end portion of the roll paper.

6. An image formation apparatus comprising the roll paper unit set forth in claim 3, the roll paper unit having a roll paper cover for covering the roll paper unit, and a slit being formed between an outside cover and the roll paper cover for discharging the precut front end portion of the roll paper.

7. The roll paper unit according to claim 2, wherein the switching member has a plate-shaped guide member which switches over a roll paper guiding face to a front side or to a reverse side corresponding to the demounted state or the incorporated state of the roll paper unit.

8. The roll paper unit according to claim 7, wherein the plate-shaped guide member has a protrusion for guiding the roll paper on at least one of the front face and the reverse face thereof.

9. An image formation apparatus comprising the roll paper unit set forth in claim 8, the roll paper unit having a roll paper cover for covering the roll paper unit, and a slit being formed between an outside cover and the roll paper cover for discharging the precut front end portion of the roll paper.

10. An image formation apparatus comprising the roll paper unit set forth in claim 7, the roll paper unit having a roll paper cover for covering the roll paper unit, and a slit being formed between an outside cover and the roll paper cover for discharging the precut front end portion of the roll paper.

11. The roll paper unit according to claim 2, wherein the plate-shaped guide member has a protrusion for guiding the roll paper on at least one of the front face and the reverse face thereof.

12. An image formation apparatus comprising the roll paper unit set forth in claim 11, the roll paper unit having a roll paper cover for covering the roll paper unit, and a slit being formed between an outside cover and the roll paper cover for discharging the precut front end portion of the roll paper.

13. An image formation apparatus comprising the roll paper unit set forth in claim 2, the roll paper unit having a roll paper cover for covering the roll paper unit, and a slit being formed between an outside cover and the roll paper cover for discharging the precut front end portion of the roll paper.

14. The roll paper unit according to claim 1, wherein the roll paper unit has a cutter for precutting the roll paper at a prescribed paper discharge path when the roll paper unit is incorporated into the image formation apparatus.

15. The roll paper unit according to claim 14, wherein the plate-shaped guide member has a protrusion for guiding the roll paper on at least one of the front face and the reverse face thereof.

16. An image formation apparatus comprising the roll paper unit set forth in claim 15, the roll paper unit having a roll paper cover for covering the roll paper unit, and a slit being formed between an outside cover and the roll paper cover for discharging the precut front end portion of the roll paper.

17. An image formation apparatus comprising the roll paper unit set forth in claim 14, the roll paper unit having a roll paper cover for covering the roll paper unit, and a slit being formed between an outside cover and the roll paper cover for discharging the precut front end portion of the roll paper.

18. The roll paper unit according to claim 1, wherein the switching member has a plate-shaped guide member which switches over a roll paper guiding face to a front side or to a reverse side corresponding to the demounted state or the incorporated state of the roll paper unit.

19. The roll paper unit according to claim 18, wherein the plate-shaped guide member has a protrusion for guiding the roll paper on at least one of the front face and the reverse face thereof.

20. An image formation apparatus comprising the roll paper unit set forth in claim 19, the roll paper unit having a roll paper cover for covering the roll paper unit, and a slit being formed between an outside cover and the roll paper cover for discharging the precut front end portion of the roll paper.

21. An image formation apparatus comprising the roll paper unit set forth in claim 18, the roll paper unit having a roll paper cover for covering the roll paper unit, and a slit being formed between an outside cover and the roll paper cover for discharging the precut front end portion of the roll paper.

22. The roll paper unit according to claim 1, wherein the plate-shaped guide member has a protrusion for guiding the roll paper on at least one of the front face and the reverse face thereof.

23. An image formation apparatus comprising the roll paper unit set forth in claim 22, the roll paper unit having a roll paper cover for covering the roll paper unit, and a slit being formed between an outside cover and the roll paper cover for discharging the precut front end portion of the roll paper.

24. An image formation apparatus comprising the roll paper unit set forth in any of claim 1, the roll paper unit having a roll paper cover for covering the roll paper unit, and a slit being formed between an outside cover and the roll paper cover for discharging the precut front end portion of the roll paper.

25. A roll paper unit constituting an image formation apparatus for forming an image on a roll paper, having an aperture for placing the roll paper set on a bar-shaped spool, comprising:

a roll paper cover for closing and opening the aperture, and a pair of spool holders which are independently turned by opening and closing of the roll paper cover between the spool removal position and the roll paper feed position with the both ends of the spool fixed rotatable, the pair of spool holders being kept at the removal position when the roll paper cover is opened, and is moved from the removal position to the paper feed position when the roll paper cover is closed, and the central shaft of the turn movement is fixed to the roll paper unit.

26. The roll paper unit according to claim 25, wherein the roll paper unit has a fixing member which is fixed movably in a direction approximately perpendicular to the direction of the spool shaft, and fixes the closed roll paper cover to the roll paper unit.

27. An image formation apparatus for forming an image selectively on either roll paper or a cut paper sheet, comprising:

a cassette for holding plural ones of cut paper sheets prior to formation of an image thereon, and a roll paper unit for holding roll paper incorporated demountably into the main body of the image formation apparatus, the roll paper unit having a cutter for cutting the roll paper, a registration roller for delivering the roll paper sheet at a predetermined timing to the image formation section, a reversal-preventing member for preventing reverse movement of the registration roller, and the roll paper unit unwound the roll paper when the roll paper unit is demounted from the main body with the roll paper held by the registration roller.

28. An image formation apparatus for forming an image selectively on either roll paper or a cut paper sheet, comprising:

a roll paper unit for holding roll paper, incorporated demountably into the main body of the image formation apparatus, a cassette for storing plural ones of the cut paper sheets before formation of an image thereon, a paper delivery path for delivering the cut paper sheets stored in the cassette, being opened when the roll paper unit is demounted from the main body of the image formation apparatus, a registration roller for delivering the roll paper sheet at a predetermined timing to the image formation section, a reversal-preventing member for preventing reverse movement of the registration roller, and the roll paper unit unwound the roll paper when the roll paper unit is demounted from the main body with the roll paper held by the registration roller.

* * * * *